US009309711B2

(12) United States Patent
Derham

(10) Patent No.: US 9,309,711 B2
(45) Date of Patent: Apr. 12, 2016

(54) WINDER ASSEMBLY

(71) Applicant: Mighton Products Limited, Saffron Walden (GB)

(72) Inventor: Michael Derham, Saffron Walden (GB)

(73) Assignee: Mighton Products Limited, Saffron Walden (GB)

( * ) Notice: Subject to any disclaimer, the term of this patent is extended or adjusted under 35 U.S.C. 154(b) by 129 days.

(21) Appl. No.: 13/906,810

(22) Filed: May 31, 2013

(65) Prior Publication Data

US 2014/0026709 A1 Jan. 30, 2014

(30) Foreign Application Priority Data

May 31, 2012 (GB) ..... 1209710.1
Dec. 19, 2012 (GB) ..... 1222903.5

(51) Int. Cl.
*E05F 5/00* (2006.01)
*E05F 11/24* (2006.01)

(52) U.S. Cl.
CPC . *E05F 5/00* (2013.01); *E05F 11/24* (2013.01); *E05Y 2800/116* (2013.01); *E05Y 2800/426* (2013.01); *E05Y 2900/148* (2013.01); *Y10T 74/20642* (2015.01)

(58) Field of Classification Search
CPC ..... E05F 11/16; E05F 11/34; E05F 15/40; E05F 11/14; E05B 65/08; E05Y 2800/16; E05Y 2800/424; Y10T 70/5146; Y10T 74/18792; E05C 9/00; E05C 17/00
USPC ..... 49/342, 449, 450, 503; 70/89
See application file for complete search history.

(56) References Cited

U.S. PATENT DOCUMENTS

| | | | | |
|---|---|---|---|---|
| 1,967,481 | A * | 7/1934 | Schaffert | 74/528 |
| 2,214,884 | A * | 9/1940 | Kistner | 70/89 |
| 3,792,467 | A * | 2/1974 | Sauveur | 341/33 |
| 5,036,620 | A | 8/1991 | Beran et al. | |
| 6,128,858 | A * | 10/2000 | Vetter et al. | 49/342 |
| 6,606,825 | B2 * | 8/2003 | Lee et al. | 49/342 |
| 8,141,295 | B2 * | 3/2012 | Carrier | 49/249 |
| 2014/0069016 | A1 * | 3/2014 | Perry et al. | 49/31 |

FOREIGN PATENT DOCUMENTS

| | | | |
|---|---|---|---|
| AU | 2006225287 | A1 | 4/2007 |
| AU | 2010202147 | A1 | 12/2010 |
| DE | 2841440 | A1 | 9/1978 |
| JP | 10280798 | A | 10/1998 |

(Continued)

*Primary Examiner* — Thomas Diaz
(74) *Attorney, Agent, or Firm* — Hayes Soloway, P.C.

(57) ABSTRACT

The present invention provides a locking unit 3 which is arranged to be fitted to existing casement window winding mechanisms. The winder assembly 1 comprises a winding mechanism 2 which is arranged to move the casement window outwardly or inwardly. In particular, the winder assembly 1 comprises a handle 48 which is rotated by a user in a first direction to open the window and in a second direction to close the window. The present invention provides a restrictor for restricting the opening of the casement window beyond a predetermined distance. In particular, the present invention is arranged to enable a user to wind the handle 48 until the casement window reaches the predetermined distance. The restrictor is automatically reset once the casement window is moved back or towards the closed position such that the casement window is within the predetermined restricted initial opening distance.

33 Claims, 16 Drawing Sheets

(56) References Cited

FOREIGN PATENT DOCUMENTS

| | | | | |
|---|---|---|---|---|
| JP | 11223067 A | * | 8/1999 | ..... E05F 11/34 |
| JP | 2006112168 | | 4/2006 | |
| KR | 200200226 A | | 10/2000 | |
| WO | 2012/159105 A1 | | 11/2012 | |

* cited by examiner

WINDER ASSEMBLY

FIELD OF THE INVENTION

The present invention relates to a locking unit for installation to a winder assembly for a window, an assembly comprising a window winder and a locking unit, a window including a window winder together with an installed locking unit, a method of installing a locking unit to a window winder and a method of restricting the opening of a window with a locking unit installed to a winder assembly. In particular, the present invention relates to a locking unit for installation to a winder assembly for a casement window, an assembly comprising a casement window winder and a locking unit, a casement window including a casement window winder together with an installed locking unit, a method of installing a locking unit to a casement window winder and a method of restricting the opening of a casement window with a locking unit installed to a casement window winder.

BACKGROUND TO THE INVENTION

Casement windows are windows in which the glazed panels or sashes are attached to the frame by one or more hinges. Usually the window is hinged vertically, such that the hinges are placed along one side of the window. However, the hinges may also be placed along a top edge (awning window) or a bottom edge.

In order to lock or secure the window in an open or closed position, most casement windows are fitted with a stay or fastener which is connected to the window frame and one side of the glazed panel. In these cases, the window is typically opened and closed by unlatching the fastener or stay and pushing the window open to the required position and then securing the window again using the stay.

Some casement windows, especially larger or heavier windows, are fitted with a winder mechanism which is used to open and close the window. As the handle of the winder is turned in a first direction, a crank arm pushes on a part of the window such that it pivots about its hinges and opens. The window may then be closed by turning the winder handle in the opposite direction.

The design of the winder mechanism is typically such that the window will stay in position when the user stops turning the handle due to the gears in the winder mechanism. Generally, therefore, windows operated using a winder do not include any other fitting to lock the window in position. It is, therefore, possible for a child to open the window simply by turning the handle, without having to disengage any locks or unlatch a fastener. This presents a risk that the child may turn the handle such that the window opens to a distance great enough that the child is able to fall out.

It is an aim of the present invention to overcome at least one problem associated with the prior art whether referred to herein or otherwise.

SUMMARY OF THE INVENTION

According to a first aspect of the present invention there is provided a locking unit for installation to a window winder wherein the window winder comprises a rotatable handle such that rotation of the handle in a first or second rotational direction causes a corresponding movement of an actuating member in a first opening direction or a second closing direction, the actuating member being connectable to a window in order to move a window from a closed position to an open position, the locking unit comprising:

locking means including a locking spindle and a locking member;

engagement means to engage with a spindle of the handle such that the locking spindle engages with the handle spindle and the handle spindle is engaged to rotate with rotation of the locking spindle;

and wherein, when the locking member is in the locked position, and the locking spindle is at a predetermined partially open locking position corresponding to a predetermined partially open position for a window, the locking member prevents rotation of the locking spindle in the opening direction which prevents rotation of the handle spindle in the opening direction and prevents the further movement of the actuating member in the opening direction beyond the predetermined partially open locking position.

Preferably the locking means can be manually released in order to allow the window to be opened beyond the predetermined partially open position.

Preferably the locking spindle comprises a first worm.

Preferably the handle spindle comprises a second worm.

Preferably the engagement means is arranged to axially engage the locking spindle with the handle spindle. Preferably the engagement means is arranged to engage the locking spindle to an outer (exposed) end of the handle spindle.

An outer end of the handle spindle may comprise splines. Preferably a first end of the locking spindle comprises a series of grooves to mesh with the splines provided on the handle spindle. A second end of the locking spindle may comprise splines. Preferably the spindles on the second end of the locking spindle are arranged to correspond to the splines provided on the outer end of the handle spindle such that a handle portion removed from the handle spindle can be fitted to the second end of the locking spindle.

Preferably the locking means includes a pivoted locking member. Preferably the locking means comprises a locking peg or locking lug. The locking peg may be provided on the pivoted locking member.

Preferably the locking means comprises a control member. The control member may comprise an abutment member.

The control member may be movable and preferably the control member is rotatable. Preferably movement of the control member defines a movement path of the abutment member.

The control member may comprise a gear and preferably comprises a worm gear or worm wheel.

Preferably the locking peg is biased towards a movement path of the abutment member.

Preferably the locking peg locates at or adjacent to a first end of the locking member.

Preferably movement of the locking member about a pivot causes the peg to be withdrawn from the movement path of the abutment member.

Preferably at the predetermined partially open position the locking peg is urged into abutment with the abutment member in order to prevent further movement of the actuating member in the opening direction.

Preferably the abutment member and/or the locking peg are shaped to prevent further movement of the actuating member from the partially open position in the opening direction.

Preferably the abutment member and/or the locking peg are shaped to allow further movement of the actuating member from the partially open position in the closing direction. Accordingly, as the window is being opened the locking means may automatically lock the window at a predetermined partially open position. Preferably as the window is being closed from a position passed the partially open position (for example, from a fully open or near fully open position), the locking means does not lock or engage the window to prevent closure of the window at the partially open position.

Alternatively, the abutment member and/or the locking peg may be shaped to prevent further movement of the actuating member from the partially open position in the closing direction. Accordingly, as the window is being opened the locking means may automatically lock the window at a predetermined partially open position. As the window is being closed from a position passed the partially open position (for example, from a fully open or near fully open position), the locking means may lock and/or engage the window to prevent closure of the window at the partially open position.

Preferably the abutment member provides an abutment surface to engage the locking peg in the opening direction.

Preferably the abutment member and/or the locking peg provide a slope or angled wall to enable the locking peg to automatically disengage with the abutment member (and/or automatically move around each other) in the closing direction.

Preferably the locking peg is arranged to abut an end surface of a part of the actuating member. As the window is opened and closed the locking peg may move over an upper surface of the control member and may be urged into engagement with the abutment member at the predetermined partially open position.

The locking means may comprise a manual activation member to enable a user to disengage the locking means.

Preferably the activation member is arranged to be manually activated and the winder assembly also requires a user to simultaneously rotate the handle in order to move the window beyond the partially open position.

Preferably the winder assembly requires a double action or dual action with both actions being performed simultaneously in order to open the window beyond the predetermined partially open position.

Preferably the activation member comprises a button which is arranged, in use, to be moved or pressed in order to disengage the locking means.

Preferably the button is arranged, in use, to be moved or pressed in order to move the locking peg out of engagement with the abutment member in the partially open position in order to allow the actuating member to be moved in the opening direction and/or the closing direction.

The activation member may comprise a first member and a second member which require independent (and/or simultaneous) manual operations to enable a user to disengage the locking means. The activation member may comprise a first button and a second button. The first button may be arranged to lock the second button in the locked position such that the locking means prevents movement in the closing direction from the locked position (the predetermined partially open position). In use, the second button may be moved to an unlocked position and then the first button is moved to an unlocked position which maintains the second button in the unlocked position.

Preferably the second button may be held in an unlocked position by latching means. Movement of the window beyond the predetermined open position may cause the latching means to unlatch the second button which may cause the locking means to be reset once the window moves back within the predetermined locking position.

The latching means may comprise magnetic means. The latching means may comprise a spring mechanism.

The latching means may comprise a pivoting latching member with an unlatching portion provide on a first end and a latching mechanism provided on a second end. The latching mechanism may comprise magnetic means and may comprise a first magnet or ferromagnetic member mounted to the second end and a second magnet or ferromagnetic member mounted to a housing.

The unlatching portion may be arranged to be moved by a release element. The release element may be mounted on the control member. Preferably the release element comprises a raised portion on the control member. Accordingly, as the control member rotates beyond the predetermined locking position, the release element is arranged to abut the unlatching portion and to pivot the latching member/release member in order to disengage/unlatch the latching means.

Preferably the unlatching portion is biased towards a movement path of the release member/release member.

Preferably the unlatching portion locates at or adjacent to a first end of the locking member and/or release member/unlatching member.

Preferably movement of the release/unlatching member about a pivot causes the unlatching portion to be withdrawn from the movement path of the release element.

Preferably the locking means requires a double action or dual action with both actions being performed simultaneously in order to unlock the locking means.

The actuating member may comprise a lever. The lever may comprise a planar member including an arm and an annular part located at one end. The annular part may comprise a series of teeth projecting radially outwards therefrom. The annular part may provide a spur gear member or a worm wheel member. The arm may be connected to a link member which is connected to the window. Preferably the link member is pivotally connected to the arm.

The control member may comprise a worm wheel. The worm wheel may comprise an upper surface over which the locking peg is arranged to move. The upper surface may also include a raised portion which forms the abutment member of the locking means. The abutment member may be integral with the worm wheel. The abutment member may be secured to the upper surface of the worm wheel.

Preferably the assembly comprises a gear mechanism to transfer movement of the handle to movement of the actuating member. The gear mechanism may comprise a gear train.

The gear mechanism may comprise a first worm (gear) and a second worm (gear). The first worm may be separate from the second worm. The first worm may be integral with the second worm. Preferably the first worm is axially aligned with the second worm. Preferably the first worm and the second worm are mounted on or form a common shaft.

The gear mechanism may comprise a control worm.

The gear mechanism may comprise an actuating worm.

Preferably rotation of the handle is transmitted to the gear mechanism to cause rotation of an actuating worm which may then engage with a worm wheel or spur gear of the actuating member to cause movement of the actuating member.

Preferably rotation of the handle is transmitted to a gear mechanism to cause rotation of a control worm which is engaged with a control member and preferably a control worm wheel. Preferably the control member is arranged to prevent further rotation of the handle and/or movement of the actuating member in an opening direction at the predetermined restricted opening distance.

According to a second aspect of the present invention there is provided a method of installing a locking unit to a window winder wherein the window winder comprises a rotatable handle such that rotation of the handle in a first or second rotational direction causes a corresponding movement of an actuating member in a first opening direction or a second closing direction, the actuating member being connectable to a window in order to move a window from a closed position to an open position, the method comprising removing a handle of the window winder to expose a handle spindle, engaging a locking spindle of the locking unit to the window winder, wherein the locking unit comprises the locking spindle and a locking member, wherein, when the window is moving in an opening direction and the window locates at a predetermined partially open position, the locking member, in the locked position, prevents rotation of the locking spindle which prevents rotation of a handle spindle in the opening direction and prevents the further movement of the actuating member in the opening direction.

Preferably the method comprises engaging the locking spindle with the handle spindle and attaching a handle to the locking spindle Preferably the method comprises engaging the handle with the locking spindle such that the locking spindle engages with the handle spindle and the locking spindle is engaged to rotate with rotation of the handle spindle Preferably the method comprises converting an unlocking window winder to a locking window winder.

Preferably the method comprises retrospectively fitting the locking unit to an existing window winder.

The method may comprise maintaining the window winder in situ whilst installing the locking unit.

According to a third aspect of the present invention there is provided an assembly comprising a window winder and a locking unit wherein the locking unit is in accordance with the first aspect of the present invention.

The assembly may comprise a window and preferably comprises a casement window.

The locking unit may comprise a replacement handle spindle.

The handle spindle and the locking spindle may be integral.

According to a fourth aspect of the present invention there is provided a method of opening and closing a window comprising operating a locking unit in accordance with the first aspect of the present invention.

According to a fifth aspect of the present invention there is provided a winder assembly for a window comprising:

a handle which is arranged, in use, to be mounted relative to a window frame;

an actuating member linked to the handle such that rotation of the handle in a first or second rotational direction causes a corresponding movement of the actuating member in a first opening direction or a second closing direction; the actuating member being connected to a window in order to move a window from a closed position to an open position; and locking means;

wherein, when the window is moving in an opening direction and the window locates at a predetermined partially open position, the locking means prevents further movement of the actuating member in the opening direction.

The actuating member may comprise a recess. The recess may be provided on an upper surface of a part of the actuating member. The actuating member may comprise a first recess and a second recess. The first recess may be arranged for use with a left hand opening window and the second recess may be arranged for a right hand opening recess.

Preferably the locking peg is biased towards the actuating member and more preferably is biased towards an upper surface of a part of the actuating member.

Preferably the locking means includes a pivoted locking member.

Preferably the locking peg locates at or adjacent to a first end of the locking member.

Preferably movement of the locking member about a pivot causes the peg to be withdrawn from the recess.

Preferably at the predetermined partially open position the locking peg is urged into the recess by biasing means in order to prevent further movement of the actuating member in the opening direction.

Preferably the recess is shaped to prevent further movement of the actuating member from the partially open position in the opening direction.

Preferably the recess is shaped to allow further movement of the actuating member from the partially open position in the closing direction. Accordingly, as the window is being opened the locking means may automatically lock the window at a predetermined partially open position. Preferably as the window is being closed from a position passed the partially open position (for example, from a fully open or near fully open position), the locking means does not lock or engage the window to prevent closure of the window at the partially open position.

Alternatively, the recess may be shaped to prevent further movement of the actuating member from the partially open position in the closing direction. Accordingly, as the window is being opened the locking means may automatically lock the window at a predetermined partially open position. As the window is being closed from a position passed the partially open position (for example, from a fully open or near fully open position), the locking means may lock and/or engage the window to prevent closure of the window at the partially open position.

Preferably the recess provides an abutment surface to engage the locking peg in the opening direction.

Preferably the recess provides a slope or angled wall to enable the locking peg to automatically disengage with the recess in the closing direction. Alternatively the recess may provide a second abutment surface to engage the peg in the closing direction.

Preferably the locking peg abuts an upper surface of a part of the actuating member. As the window is opened and closed the locking peg may move over the upper surface of the actuating member and may be urged into the recess at the predetermined partially open position.

The annular part of the actuating member may comprise an upper surface over which the locking peg is arranged to move. The upper surface may also include an indentation which forms the recess of the locking means. The upper surface may include a first recess and a second recess. The first recess may be arranged for a left hand opening window and the second recess may be arranged for a right hand opening window.

Preferably the assembly comprises a gear mechanism to transfer movement of the handle to movement of the actuating member. The gear mechanism may comprise a pair of bevel gears. The gear mechanism may comprise a worm gear. Preferably rotation of the handle is transmitted through the bevel gears to cause rotation of the worm gear which may then engage with the spur gear to cause movement of the actuating member.

According to a sixth aspect of the present invention there is provided a method of opening and closing a window comprising rotating a handle in a first or second rotational direction in order to cause an actuating member to move in a first opening direction or a second closing direction to open and close the window; the method further comprising causing locking means to engage to prevent further opening movement of the window when the window locates at a predetermined partially open position as the handle opens the window.

The method may comprise rotating a handle in a first or second rotational direction in order to cause an actuating member to move in a first opening direction or a second closing direction to open and close the window; the method further comprising causing locking means to engage to prevent further opening movement of the window when the window locates at a predetermined partially open position as the handle opens the window.

Preferably the locking means automatically engages and prevents further opening of the window when the window locates at the predetermined partially open position.

Preferably the locking means automatically disengages and allows closing of the window when the window locates at the predetermined partially open position. Alternatively, the locking means may automatically engage and prevent closing of the window when the window locates at the predetermined partially open position.

Preferably the method comprises manually operating an activation member of the locking means to disengage the locking means and allow further opening of the window when the window locates at the predetermined partially open position.

The method may comprise manually operating an activation member of the locking means to disengage the locking means and allow further closing of the window when the window locates at the predetermined partially open position.

The method may comprise activating a first member or button and a second member or button to disengage the locking means and allow further opening of the window when the window locates at the predetermined partially open position.

Preferably the method comprises, when the window locates at the predetermined partially open position, manually operating an activation member of the locking means to disengage the locking means and simultaneously rotating the handle to open the window beyond the predetermined partially open position According to a seventh aspect of the present invention there is provided a window assembly comprising a window, a window frame and a winder assembly, the winder assembly comprising:

a handle which is arranged, in use, to be mounted relative to the window frame;

an actuating member linked to the handle such that rotation of the handle in a first or second rotational direction causes a corresponding movement of the actuating member in a first opening direction or a second closing direction; the actuating member being connected to the window in order to move the window from a closed position to an open position; and locking means;

wherein, when the window is moving in an opening direction and the window locates at a predetermined partially open position, the locking means prevents further movement of the actuating member in the opening direction.

BRIEF DESCRIPTION OF THE DRAWINGS

The invention will now be further described, by way of example only, and with reference to the accompanying drawings, in which.

DESCRIPTION OF THE PREFERRED EMBODIMENTS

Figure 1:
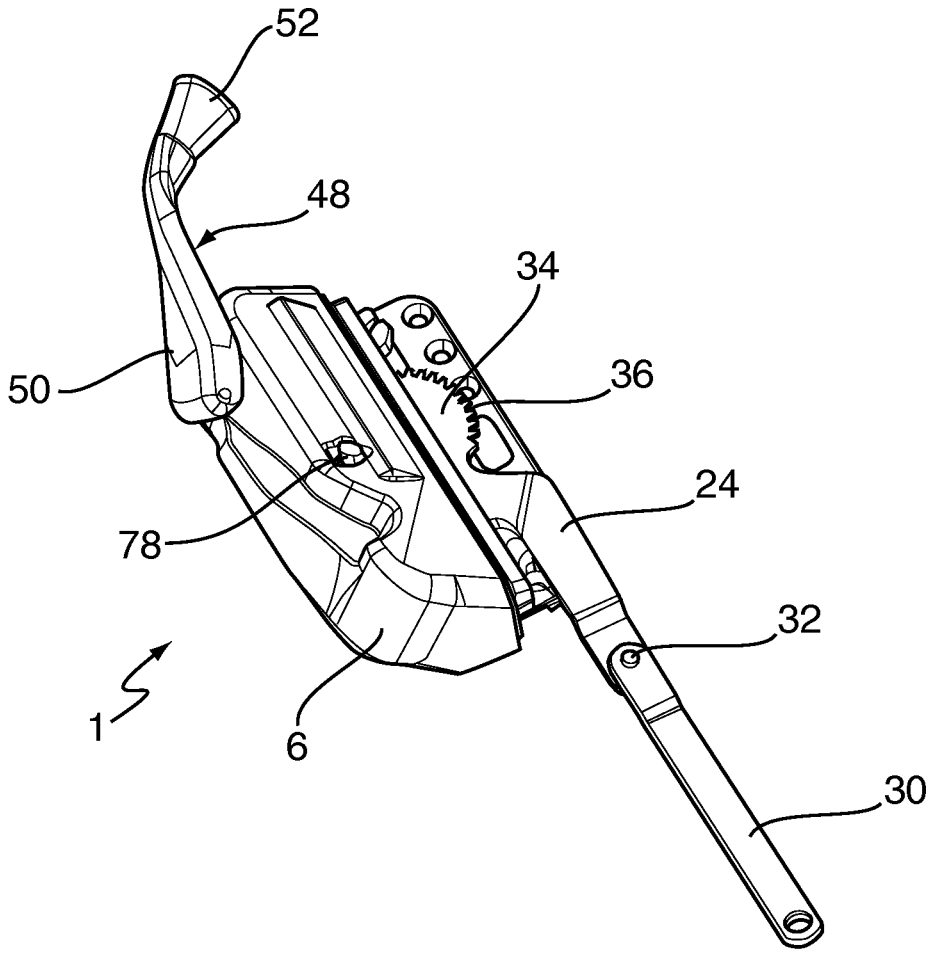
FIG. 1 is a perspective view of a preferred embodiment of a locking unit installed to a winder assembly.
Figure 2D:
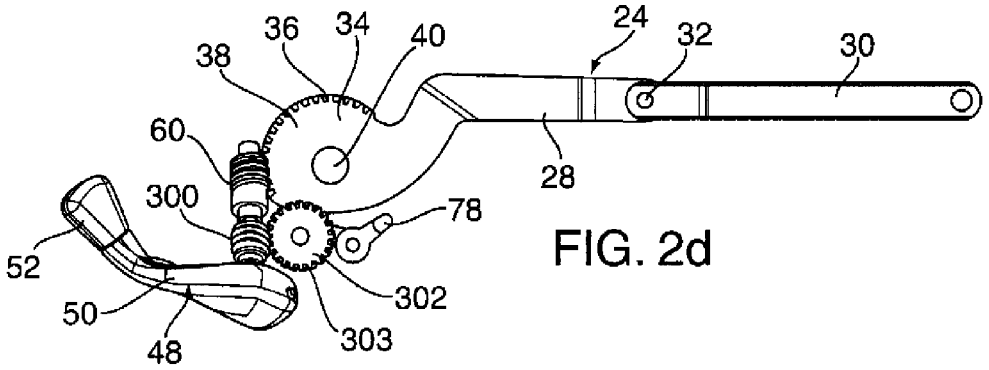
FIG. 2*d* is a top view of a part of a preferred embodiment of a locking unit installed to a winder assembly.
Figure 2C:
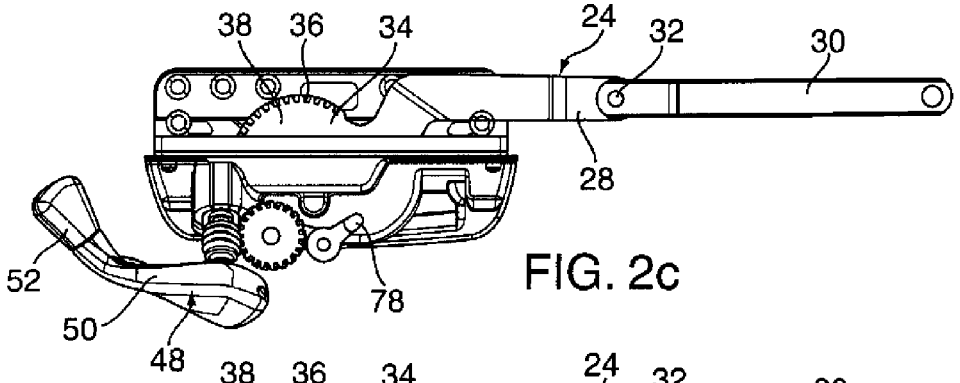
FIG. 2*c* is a top view of a part of a preferred embodiment of a locking unit installed to a winder assembly.
Figure 2B:
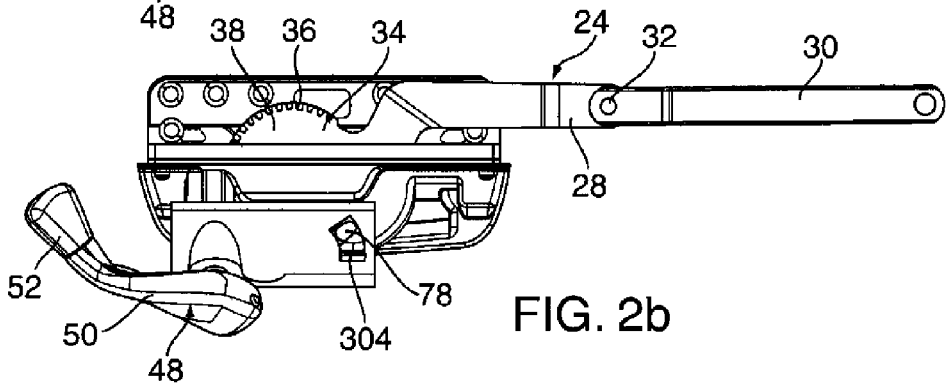
FIG. 2*b* is a top view of a part of a preferred embodiment of a locking unit installed to a winder assembly.
Figure 2A:
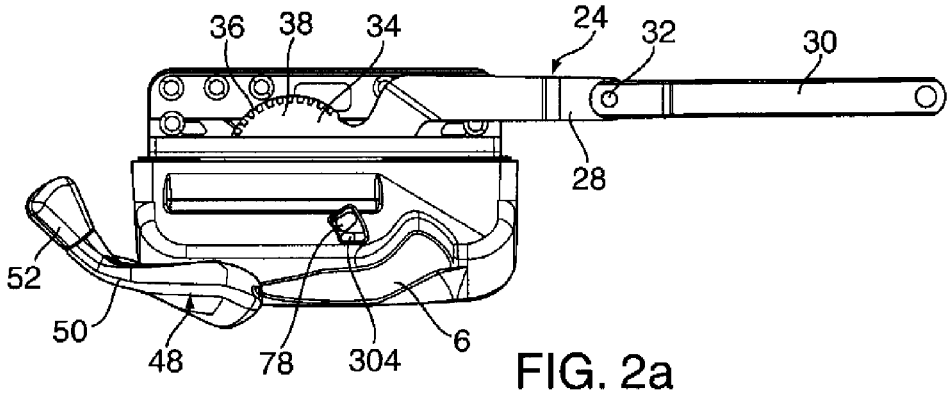
FIG. 2*a* is a top view of a preferred embodiment of a locking unit installed to a winder assembly.

FIGS. 1 to 5 show a winder assembly 1 with a locking unit 3 installed according to a preferred embodiment of the present invention. In particular, the winder assembly 1 is for use with the opening and closing of casement windows which are hinged along a single edge. Conventionally, a winder assembly 1 will be secured midway along a bottom frame member of a window frame with the casement window being arranged to pivot outwardly along either the left hand edge or right hand edge.

The winder assembly 1 comprises a winding mechanism 2 which is arranged to move the casement window outwardly or inwardly. In particular, the winder assembly 1 comprises a handle 48 which is rotated by a user in a first direction to open the window and in a second direction to close the window.

The present invention provides a restrictor for restricting the opening of the casement window beyond a predetermined distance. In one embodiment, the present invention is arranged to enable a user to wind the handle 48 until the casement window reaches the predetermined distance and then requires the user to move a button 78 and hold this button 78 in a disengaged position whilst the handle 48 is rotated further to move the window beyond the predetermined restricted opening distance. In the preferred embodiments, the user is required to move a locking button 79 prior to moving an operating button 78 to then enable the handle 48 to be rotated further than the predetermined locking distance. Once the casement window is beyond this predetermined distance, the user can release the buttons 78, 79 and the handle 48 can then be used to fully open the casement window.

In particular, the winder assembly 1 requires (at least) two independent actions (a double action or dual action mechanism) with both actions being performed simultaneously in order to open the window beyond the predetermined partially open position.

The restrictor of the present invention is automatically reset once the casement window is moved back or towards the closed position such that the casement window is within the predetermined restricted initial opening distance. Accordingly, the subsequent fully opening of the window will again require the user to move and hold the button(s) 78, 79 whilst simultaneously, in some embodiments, rotating the handle 48 in order to move the casement window beyond the initial restricted opening distance.

The present invention provides a locking unit 3 which is arranged to be fitted to existing casement window winding mechanisms. The locking unit 3 includes all of the locking means and is contained within a housing 400 which can be fitted to or within the existing winder housing 6. In some embodiments, the existing winder housing 6 may need to be replaced in order to contain the locking unit 3. The locking unit 3 simply connects to an existing shaft of the handle 48 of the winder mechanism or a replacement shaft/spindle may be used. Accordingly, the locking unit 3 can be simply and easily fitted and only requires the existing winder mechanism to be able to provide access to the handle shaft.

Figure 3C:
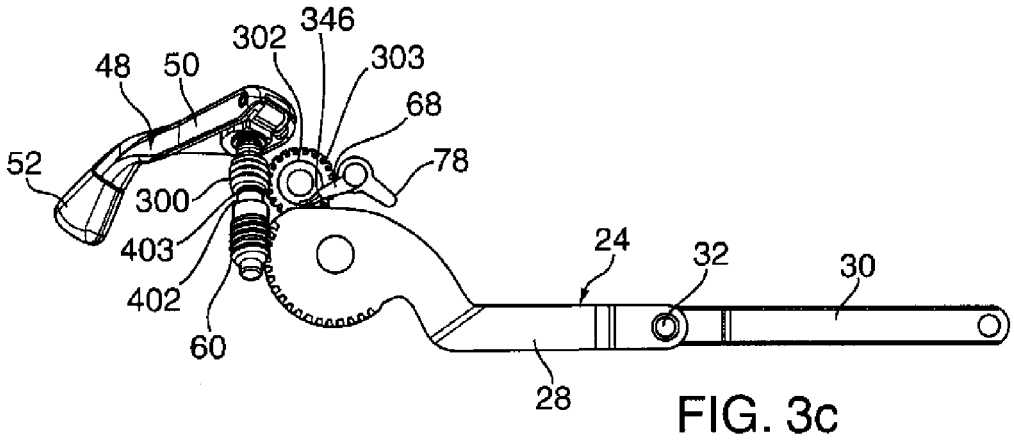
FIG. 3*c* is a bottom view of a part of a preferred embodiment of a locking unit installed to a winder assembly.
Figure 3B:
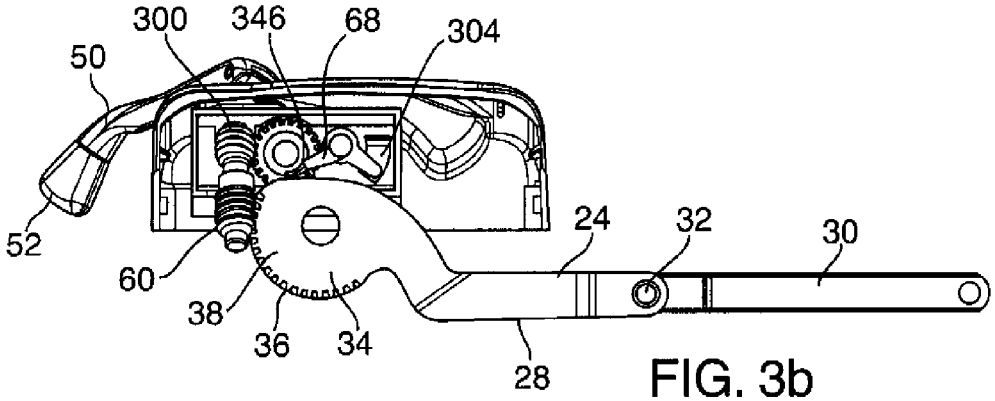
FIG. 3*b* is a bottom view of a part of a preferred embodiment of a locking unit installed to a winder assembly.
Figure 3A:
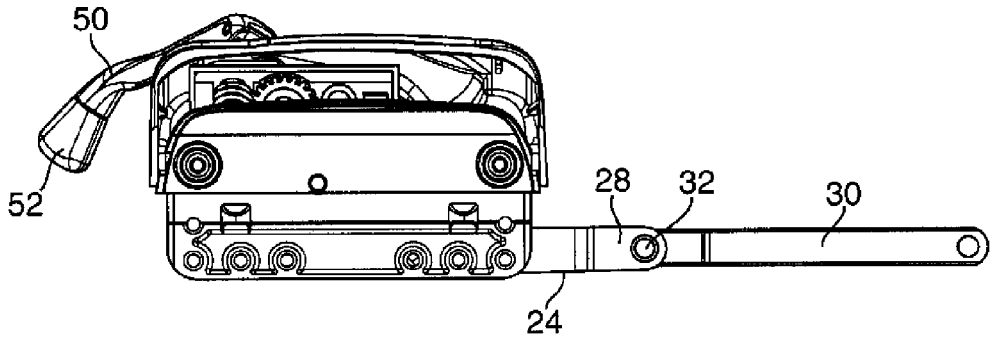
FIG. 3*a* is a bottom view of a preferred embodiment of a locking unit installed to a winder assembly.
Figure 5:
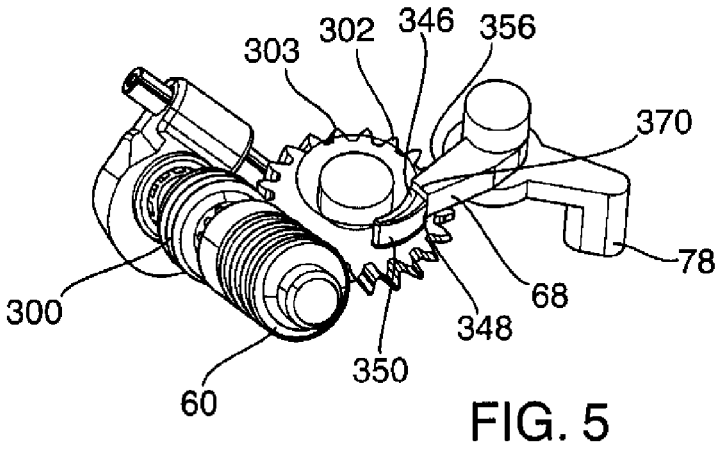
FIG. 5 is a perspective view of a gear mechanism of a preferred embodiment of a locking unit installed to a winder assembly.
Figure 4:
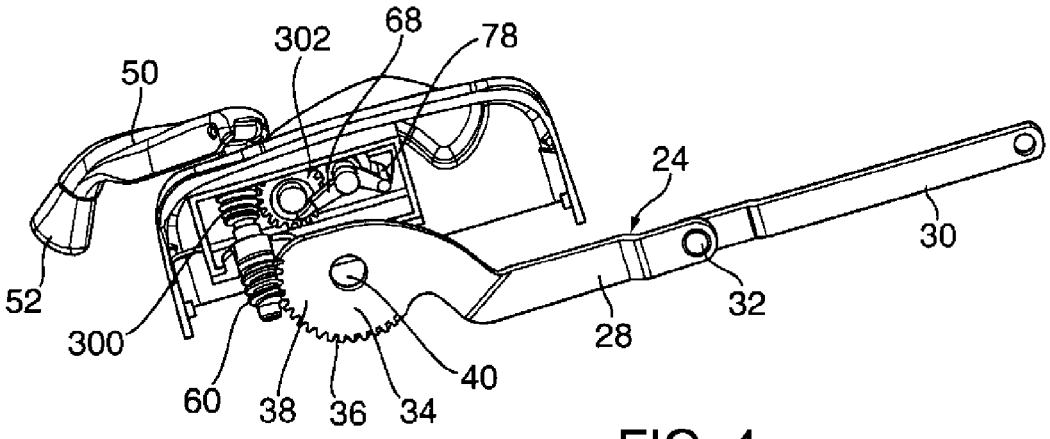
FIG. 4 is a perspective view of a part of a preferred embodiment of a locking unit installed to a winder assembly.

In existing winder mechanisms, the handle 48 is removable from the handle shaft (spindle) and this leaves an engageable portion 403 of the shaft (spindle) 402 exposed, as shown in FIG. 3*c*. This will typically comprise an end of the handle spindle 402. A locking spindle 404 of the locking unit 3 can then be secured to this exposed portion 403 in the same manner as the handle 48 was attached. Accordingly, the two spindles 402, 404 are engaged axially in an end to end arrangement and both spindles comprise elongate members. The locking spindle 404 then provides a similar exposed shaft portion 405 to which the existing or previous handle 48 can be reattached such that the winder mechanism 1 is still operated by the supplied handle 48. The exposed portion 405 provides a series of splines 452 which can be engaged in corresponding grooves provided by the handle attachment. The handles grooves will be of the same configuration as the grooves 450 provided in the end of the locking spindle 404. Accordingly, the locking unit 3 of the present invention can be used to convert an unlocking winder mechanism to a locking winder mechanism. It will also be appreciated that the present invention can be used to adapt an existing locking winder mechanism and may provide a different locking functionality. The locking unit 3 of the present invention provides a locking mechanism that requires a dual action to operate and also provides a locking function such that the window is automatically locked at a predetermined opening distance and the locking mechanism automatically resets once the window is moved backed to a position within the predetermined distance.

In summary the present invention provides an add on locking unit 3 for existing hardware. The present invention does not necessarily provide a new design of winder (operator) unit, but will be fitted on top of an existing operator. There will be subtle variations on the external features of the locking unit to make it physically compatible with different manufacturers but the internal design will be the same for all variants. The unit 3 is fitted to an existing operator by first removing the winder handle 48, the unit 3 is the placed over the operator spindle 403 and the handle 48 refitted then to the units spindle 403. In some embodiments, the handle spindle may also be replaced and the locking spindle 404 and the handle spindle 402 may be integral.

In the preferred embodiment, the winder assembly 1 is secured to the window frame by any suitable means. The winding mechanism 2 includes an actuating member or lever 24 which is in the form of a planar or flat bar. An aperture 26 is provided in a first, distal end, of an arm 28 of the lever 24 to enable the lever 24 to be linked to the rail or style of the window sash. The end of the lever 24 may be connected directly to the window sash or, alternatively, it may be connected to one or more arms 30 that provide a hinged connection between the lever 24 and the window sash.

In the preferred embodiment, the end of the lever 24 is connected to a further arm 30 and a rotatable pivot in 32 is located in an aperture at the end of the lever 24 so as to provide a purely rotational connection to the hinged arm 30.

At a second end of the actuating member or lever 24 there is an annular portion 34. The annular portion 34 comprises a series of teeth 36 that project radially outwardly from at least part of the circumference of the annular portion 34. The teeth 36 extend in the same plane as the actuating member 24 and this forms a segment of a spur gear 38 or worm wheel. In the preferred embodiment, the radial region of the teeth 38 extends around approximately half of the circumference of the annular portion 34. The arm 28 of the actuating lever 24 extends radially from the part of the annular portion 34 without teeth. In this way, the spur gear (or worm wheel) segment 38 is provided at the proximal end of the actuating member 24. The arm 24 may comprise a transition section or elbow in order for the arm 24 to extend from the annular portion 34 without teeth 38 and for the arm 24 to extend in the desired direction.

The annular portion 34 of the actuating lever 24 locates around a spindle of the winder assembly 1. The spindle acts as a fixed axle about which the actuating member 24 is rotatable.

As previously mentioned, a rotatable handle 48 is used to operate the winding mechanism 2. The handle 48 comprises a crank, including a connecting member 50 and a grip 52. In the preferred embodiment, the grip is rotatable such that the grip rotate as the user rotates the handle 48 and the grip is kept stationary relative to the hand or fingers of the user.

The winder assembly 1 includes a gear mechanism comprising a gear train which links the handle 48 to the actuating lever 24 such that rotation of the handle 48 causes a corresponding rotation of the annular portion 34 of the actuating lever 24 about the axis and the actuating lever 24 thereby moves the window sash to which it is secured.

In particular, the second end of the handle spindle 402 is connected to a control worm (gear) 300. In addition, the handle 48 is connected to a worm (gear) 60 or actuating worm gear which is engaged with the teeth 36 of the spur gear segment 38 of the actuating lever 24. In the preferred embodiment, the winder assembly comprises two separate worm gears 60, 300 although in other embodiments a single dual function worm gear may be used. Both of the worm gears 60, 300 or worm gear portions are arranged to rotate simultaneously with rotation of the handle 48.

The winder assembly 1 comprises a control gear 302 comprising a worm wheel 302 (or spur gear) which includes teeth 303 which are engaged with the teeth of the control worm 300. Accordingly, as the handle 48 rotates, the control worm gear 300 rotates which thereby causes rotation of the control worm wheel 302.

The control worm wheel 302 forms part of the locking means in the locking unit 3 which is arranged to restrict the movement of the actuating lever 24 in the opening direction. In particular, the control worm wheel 302 includes a locking element comprising an abutment member 346 which is arranged to abut a locking member (locking peg) 68 at the predetermined restricted opening position in order to prevent any further opening of the window.

The locking member 68 comprises a locking face 370 which is arranged to directly abut a locking face 348 of the locking element 346.

As shown in FIGS. 1 to 5, it can be seen that as the control worm wheel 302 rotates the locking element 346 which will also move radially around the axis of the control gear. The locking element 346 thereby has a predetermined movement path. Since this path is set and predetermined, the winder assembly 1 can be restricted by moving the locking member 68 into or out of this movement path to prevent further movement at a specific point and in a single (rotational) direction.

In the preferred embodiment, the locking element 346 comprises a raised lug provided on a planar, annular upper surface of the control worm wheel 302.

The locking member 68 is pivoted about a pivot pin and comprises a first arm providing the locking member (or locking lug) 68 and a second arm comprising a button 78. The button 78 is arranged to project outwardly through a radial slot 304 in the outer cover 6 and/or housing 400. This slot 304 determines the range of movement of the button 78. Preferably, the locking member 68 includes urging means in order to bias or urge the abutment face 370 of the locking member 68 into the path of the abutment face 348 of the abutment member 346.

At the predetermined restricted opening position, the abutment face 348 of the abutment member 346 and the abutment face 370 of the locking member 68 directly abut each other to prevent any further rotation of the handle 48 and to thereby prevent the window from being opened any further. The faces 348, 370 of the abutment member 346 and the locking member 68 are angled such that the movement of the button 78 easily disengages the abutment faces 348, 370. In this disengaged position, the handle 48 can be rotated further such that the worm gears 60, 300 and control worm wheel 302 will be rotated further and for the abutment faces 348, 370 to pass each other. Once the abutment faces 348, 370 have passed this position, the user can release the button 78 and the locking member 68 will be urged towards the rest position.

In another preferred embodiment of the present invention, the activation member comprises a dual action activation member(s). The user is required to perform two independent actions in order to unlock the locking member 68. This further secures the window, especially against inadvertent release of the window or the unlocking of the window by a small child. The release means may comprise a first button 78 as described. However, the operating button 78 may be held in a locked position until a (second) locking button (member) 79 is operated. The locking button 79 is moved out of engagement with the operating button 78 to enable the operating button 78 to be movable to an unlocked position. Accordingly, in order to unlock the window from the partially open position, first the user operates a locking button 79 which may comprise a sliding button which retains the operating button 78 in a locked position. Once the locking button 79 has been moved to an unengaged position the user can then move the operating button 78 to the unlocked position. The user may or may not have to physically retain the operating button 78 and/or the locking button 79 in this position. In this configuration the user can then rotate the handle 48 to move the window beyond the partially open position. Accordingly, the locking means requires a dual action which comprises two combined independent movements and/or mechanisms. The user may also have to rotate the handle 48 with the locking means being retained in the unlocked position.

The abutment member (locking lug) 346 and the locking member 68 both comprise angled and/or cooperating faces 350, 356 such that as the window is moved towards the closed position from the fully open position, the user does not need to manually operate the button 78 to move passed the restricted opening position.

It can be seen from the figures, that the outer surface 350 of the abutment member 346 will abut the inner face 356 of the locking member 68 and the locking member 68 will rotate outwardly slightly until the window reaches the predetermined restricted position at which point, the urging means will bias the locking member 68 back in the path of the abutment member 346 and the window restrictor will have been automatically reset.

As shown in FIG. 6 to FIG. 15, a self contained locking unit 3 is supplied to enable the conversion of an existing winder mechanism to provide a locking winder mechanism with the locking functionality as herein described.

The locking unit 3 comprises locking means in the form of a locking worm wheel 302 which is selectively locked by a pivoting locking member 68. In particular, an end face 370 of the locking member 68 is arranged to abut an end face 348 of a locking element 346 provided on the worm wheel 302.

The locking member 68 is effectively controlled by an operating button 78 which cooperates with a locking button 79. The locking member 68 and the associated buttons also include a latching mechanism as will be described. The operating button 78 includes bias or urging means to urge the operating button to the locked opposition. Similarly the locking button 79 includes bias or urging means to urge the locking button to the locked position.

Figure 6:
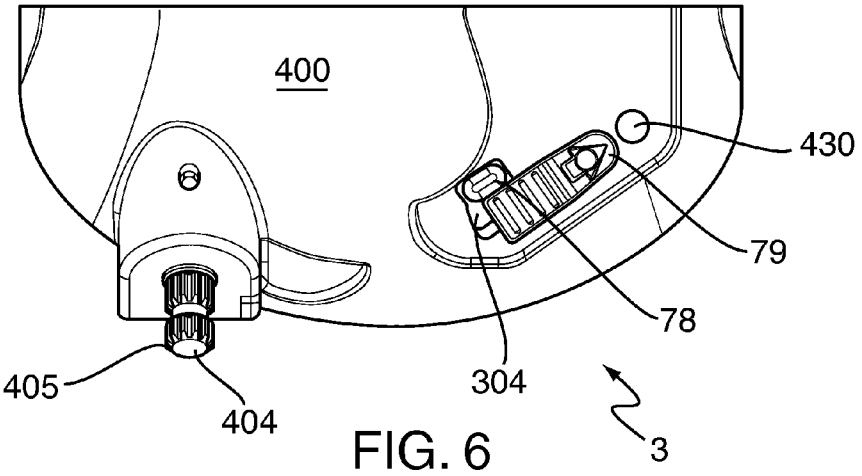
FIG. 6 is a top view of a second preferred embodiment of a locking unit installed to a winder assembly with the window closed and the locking mechanism engaged.
Figure 7:
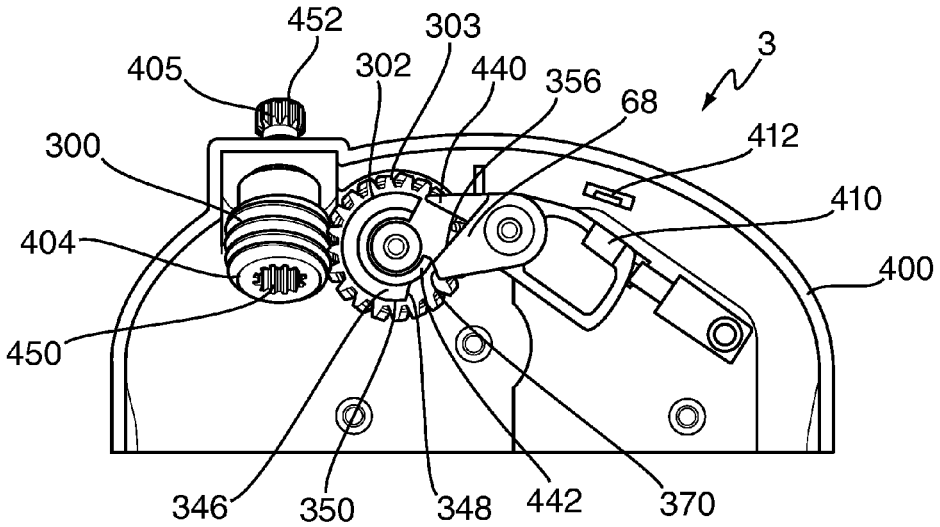
FIG. 7 is a bottom view of a second preferred embodiment of a locking unit installed to a winder assembly with the window closed and the locking mechanism engaged.
Figure 8:
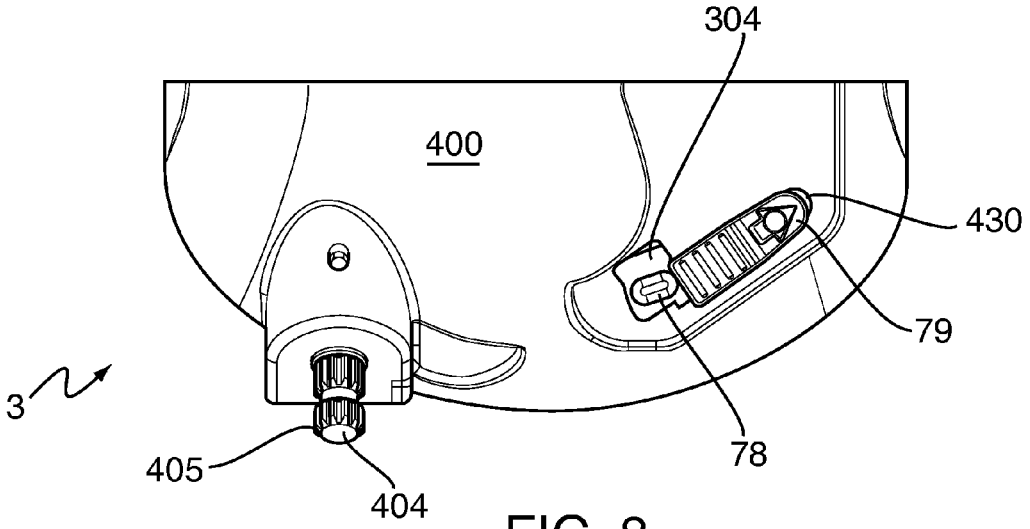
FIG. 8 is a top view of a second preferred embodiment of a locking unit installed to a winder assembly with the window closed and the locking mechanism disengaged.
Figure 9:
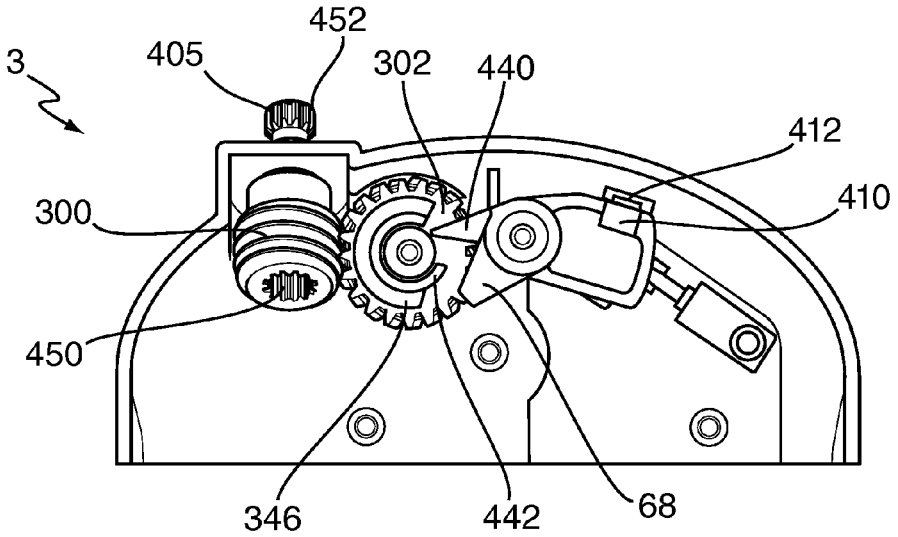
FIG. 9 is a bottom view of a second preferred embodiment of a locking unit installed to a winder assembly with the window closed and the locking mechanism disengaged.

As shown in FIG. 6 and FIG. 7, both buttons 78, 79 are in a rest position in which the window is closed and the locking member 68 is positioned to prevent the window being opened beyond the predetermined opening position. Whilst the window is within this unrestricted opening region, the locking button 79 can be slid away to cover an alert indicator 430 and the operating button 78 can be slid to an unlocked position, as shown in FIG. 8 and FIG. 9. It can be seen that in this configuration, the end face 370 will not abut the end face 348 and the control worm wheel 302 is free to rotate which enables the window to be opened beyond the predetermined locking position. The alert indicator 430 is used to visually indicate that the locking unit is in the unlocked configuration.

The latching means comprise a first magnet 410 mounted to a part of the locking member 68 and a second magnet 412 mounted on a part of the housing 400. As the operating button is moved to the open position the two magnets secure together and retain the buttons 78, 79 and the locking member 68 in an unlocked or disengaged position. In other embodiments, the latching means comprises a spring mechanism.

Figure 10:
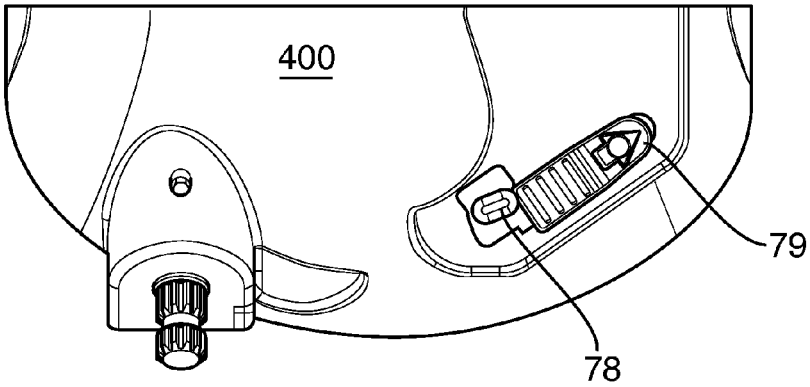
FIG. 10 is a top view of a second preferred embodiment of a locking unit installed to a winder assembly with the window open beyond the locking position and the operating button disengaged.
Figure 11:
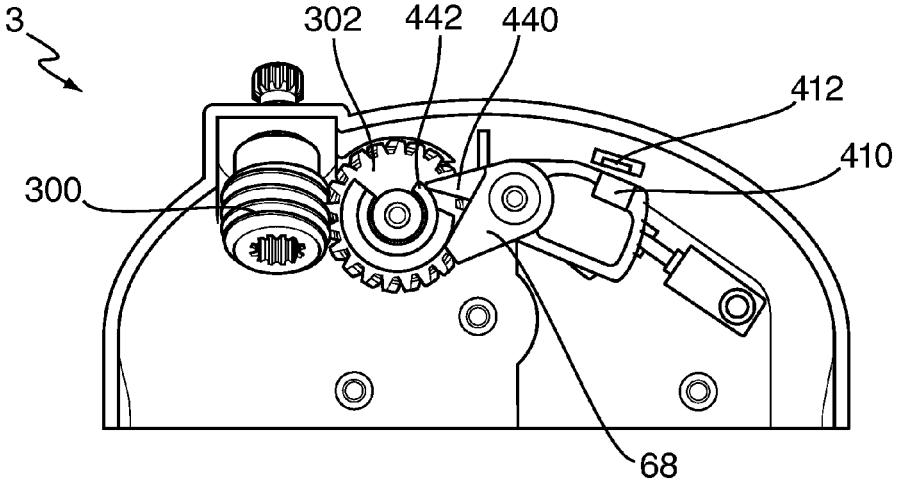
FIG. 11 is a bottom view of a second preferred embodiment of a locking unit installed to a winder assembly with the window open beyond the locking position and the operating button disengaged.

The latching means also includes a release mechanism to move to an unlatched state. The release mechanism comprises a release member 440 connected to the locking member 68. The release member 440 includes a shaped surface which is arrange to cooperate with a shaped release abutment on a release element 442 provided on the locking worm wheel 302. As the handle 48 is rotated, the locking worm wheel 302 rotates and the release abutment 442 will move the release member outwardly which forces the magnets 410, 412 apart such that the magnets 410, 412 no longer hold the button(s) 78, 79 in a disengaged position. This position is shown in FIG. 10 and FIG. 11.

Figure 12:
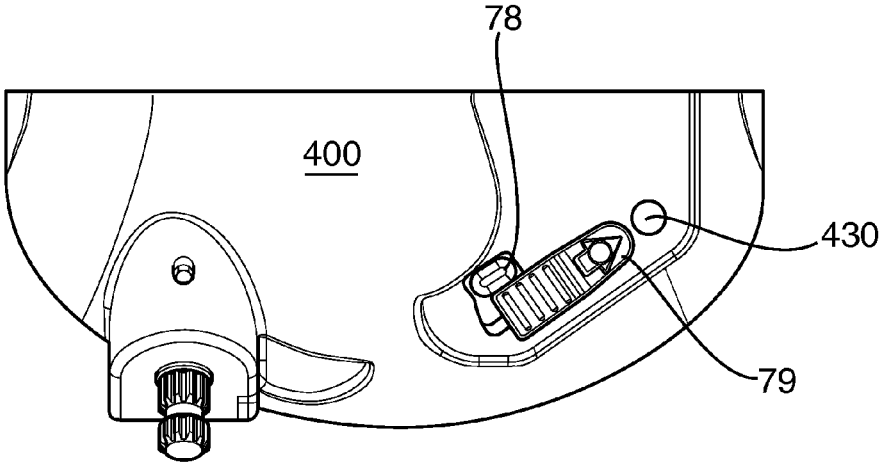
FIG. 12 is a top view of a second preferred embodiment of a locking unit installed to a winder assembly with the window within the locking position and the locking mechanism engaged.
Figure 13:
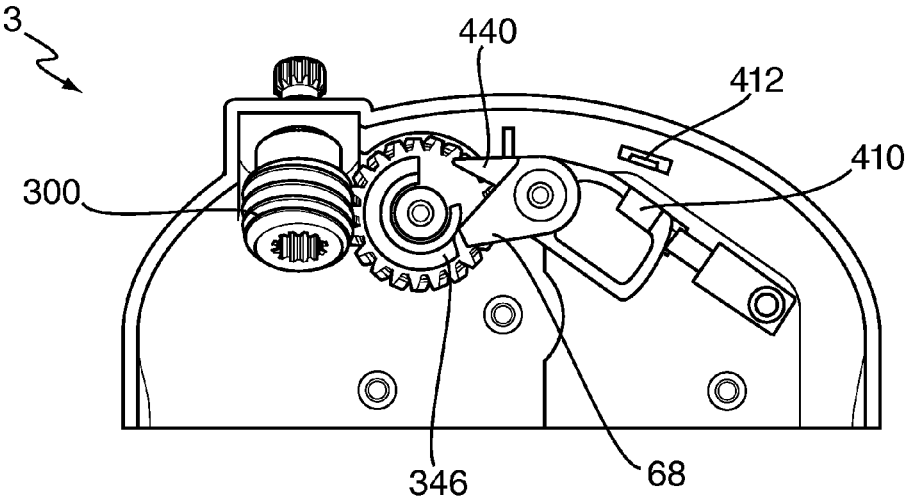
FIG. 13 is a bottom view of a second preferred embodiment of a locking unit installed to a winder assembly with the window within the locking position and the locking mechanism engaged.
Figure 14:
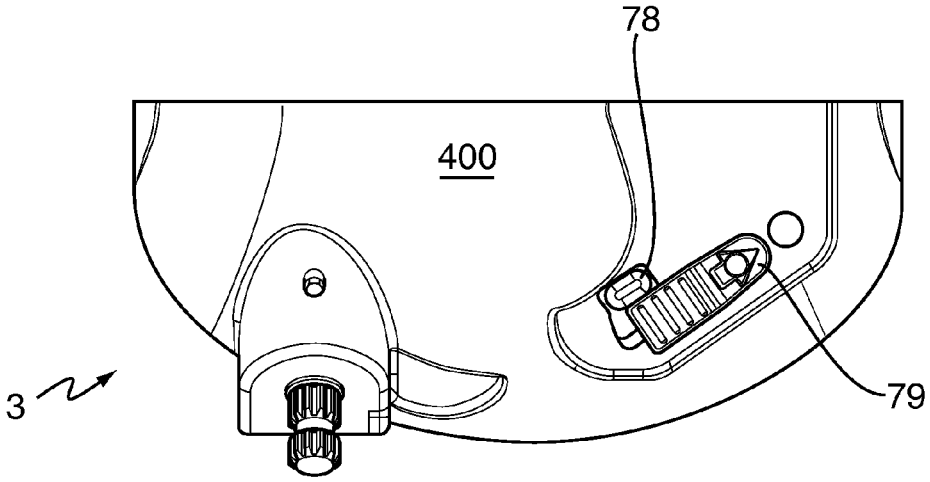
FIG. 14 is a top view of a second preferred embodiment of a locking unit installed to a winder assembly with the window at the locking position and the locking mechanism engaged.
Figure 15:
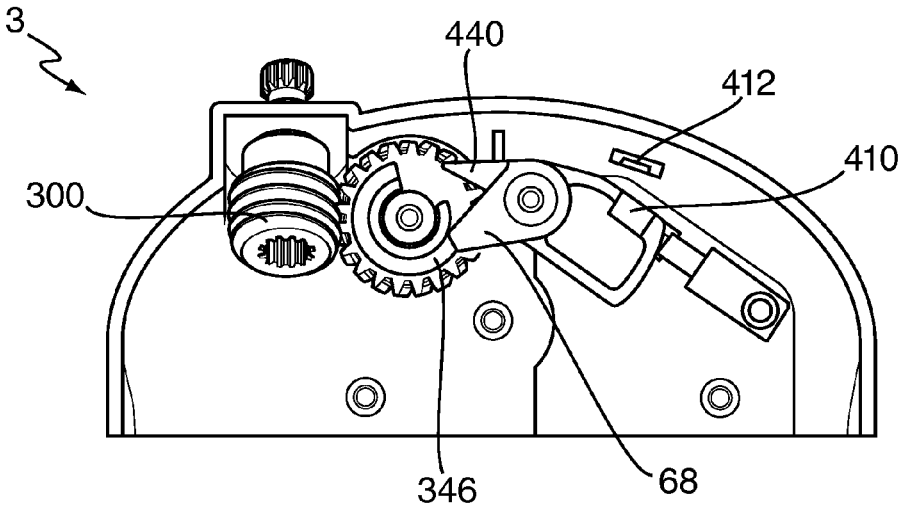
FIG. 15 is a bottom view of a second preferred embodiment of a locking unit installed to a winder assembly with the window at the locking position and the locking mechanism engaged.

In other words, when the latching member 68 is moved into the disengaged position, the release member is moved into the line of movement of the release element 442. The movement of the locking worm wheel 302 beyond the locking position causes the release element 442 to abut the release member 440 and pivot the release member 440 such that this breaks the contacts between the magnets. It will be appreciated that one of the magnets could be replaced with a member comprising a suitable ferromagnetic material. In other embodiments, a spring mechanism is used instead of the magnetic arrangement As the window subsequently closes, the locking member 68 is urged back into the locked position with the locking means having been automatically reset to prevent the window form being moved beyond the locked position again, as shown in FIG. 12 and FIG. 13. This subsequently locked position is shown in FIG. 14 and FIG. 15 which clearly shows the end face of the 370 of the locking member 68 abutting the end face 348 of the locking element 346 to restrict the opening distance of the window.

Figure 16A:
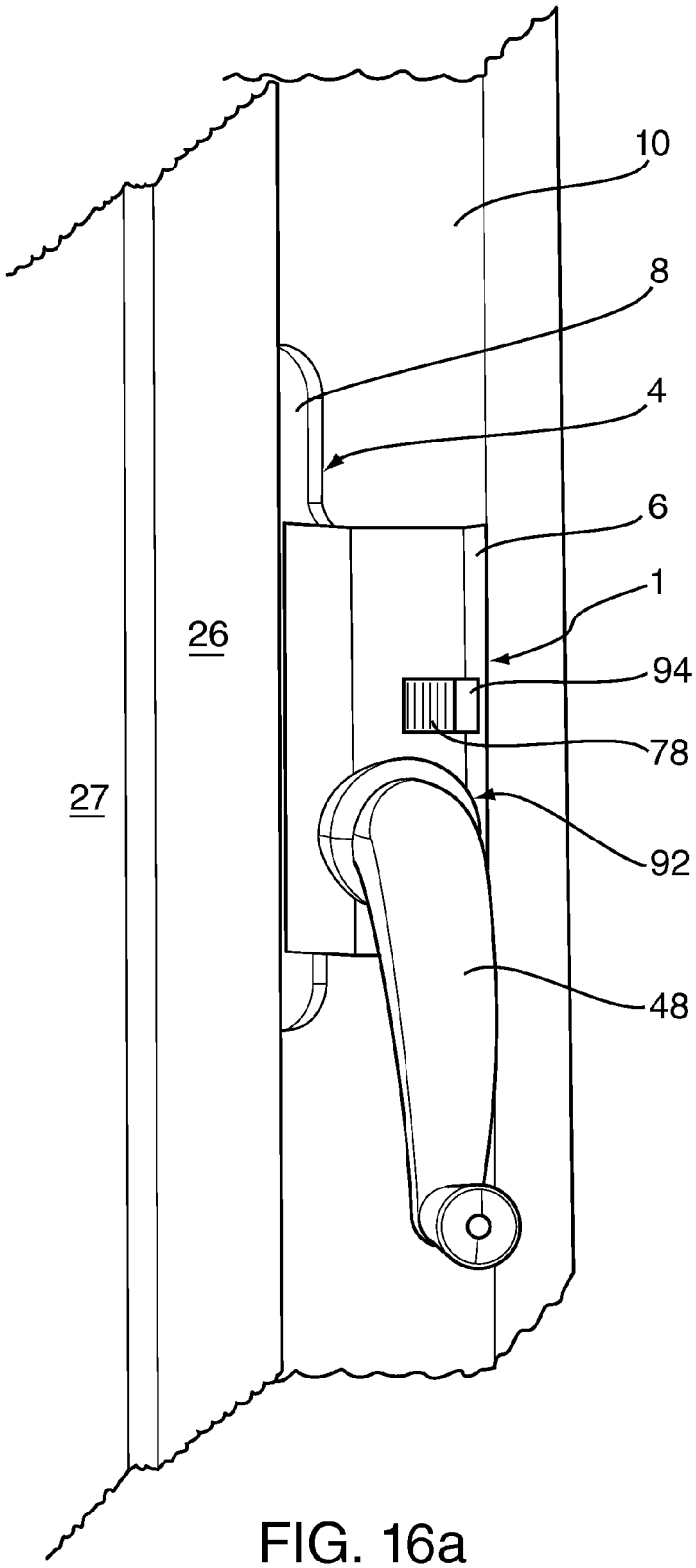
FIG. 16*a* is a perspective view of an embodiment of a winder assembly in accordance with one aspect of the present invention attached to a window frame, with the window closed.
Figure 16B:
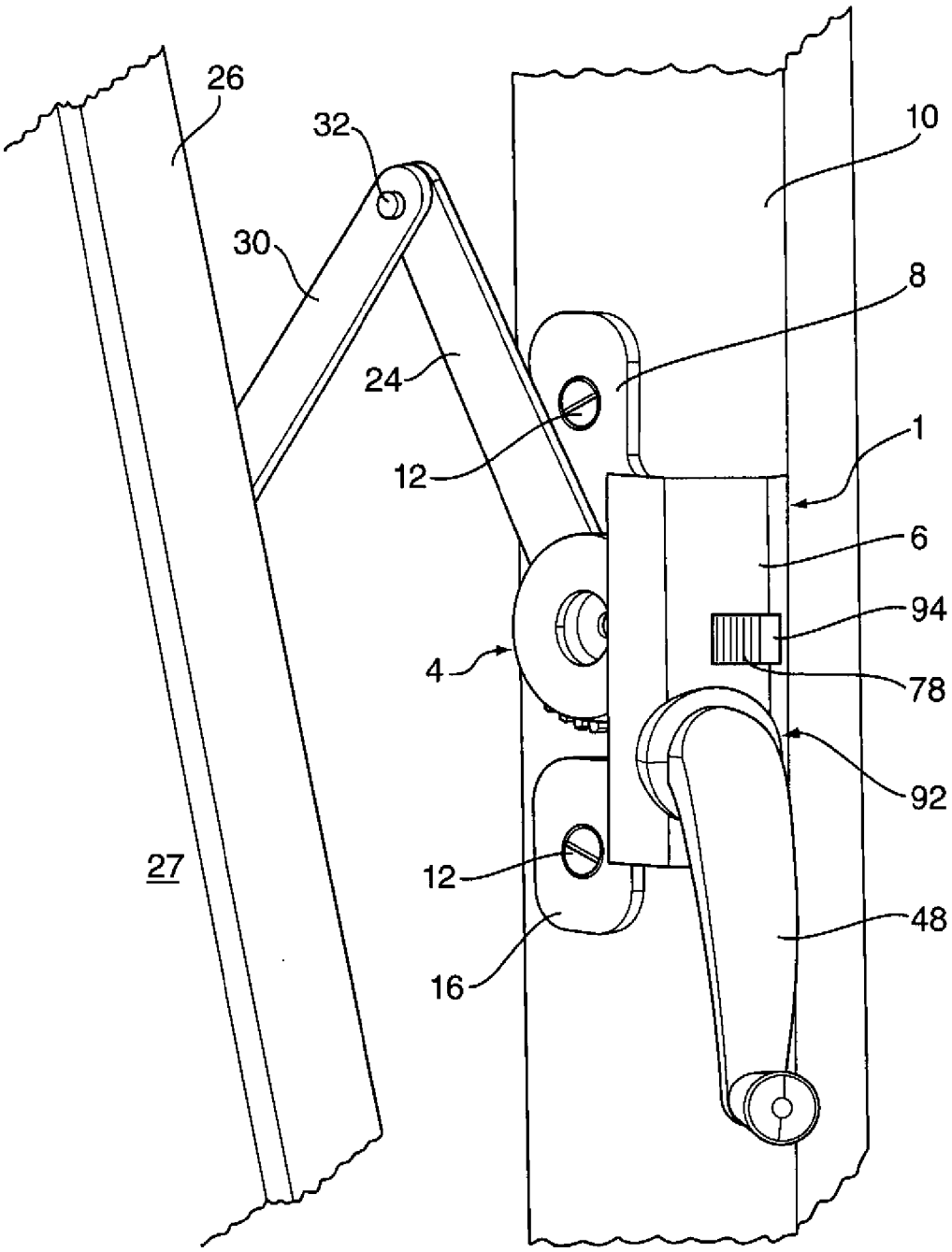
FIG. 16*b* is a perspective view of the winder assembly of FIG. 16*a*, with the window open.

FIGS. 16*a* and 16*b* show a winder assembly 1 according to one or more aspects of the present invention. The winder assembly includes an integrated locking system rather than a simple retro fitted locking unit for an existing winder unit in accordance with the first aspect and claim 1 of the present invention. The winder assembly 1 is used to open and close casement windows that are hinged along one edge. Typically the winder assembly 1 will be fixed to the top or bottom of a window adjacent the hinged edge. However, the winder assembly 1 may also be positioned along the edge of the window opposite the hinge.

The winder assembly 1 comprises a winding mechanism 2, a support bracket 4 and an outer cover 6. The support bracket 4 supports both the winding mechanism 2 and the outer cover 6, and additionally includes a mounting plate 8 for attaching the winder assembly 1 to a window frame 10. The winder assembly 1 is fixed to a window frame 10 by screws 12 that pass through holes 14 in the mounting plate 8. The holes 14 will typically have bevelled edges so that the screws 12 may be countersunk such that the tops of the heads of the screws 12 lie flush with the top surface of the mounting plate 8. In this example the mounting plate 8 is shaped such that two rectangular securing portions 16 project out from, but lie in the same plane as, two adjacent corners of a larger rectangular portion, such that there is a space 18, between the two securing portions 16, extending along one edge of the larger rectangular portion. The holes 14 are formed in the centre of each of the securing portions 16.

Figure 17:
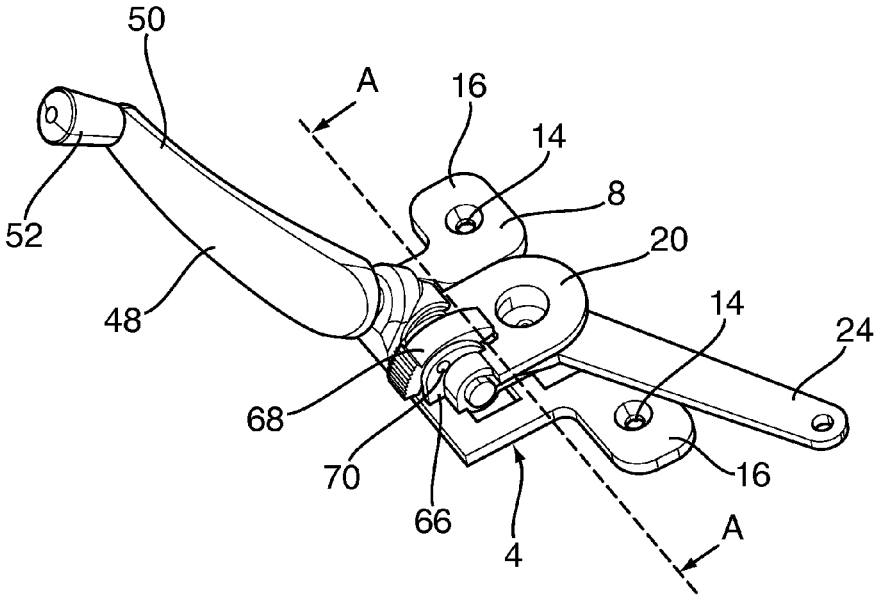
FIG. 17 is a perspective view of the winder assembly of FIG. 16*a* detached from the window frame and with the cover removed.

The support bracket 4 also includes an upper retaining plate 20 that lies parallel to but spaced apart from the mounting plate 8, shown most clearly in FIGS. 17 and 9. The upper retaining plate 20 overhangs the space 18 between the securing portions 16 and a front edge of the upper retaining plate 20 has a semi-circular profile. A cylindrical spindle 22 extends perpendicularly from the lower face of the upper retaining plate 20 in a direction towards the space 18 in the mounting plate 8. The spindle 22 is rigidly fixed to, and may be integrally formed with, the upper retaining plate 20.

The winding mechanism 2 includes an actuating member or lever 24, which is in the form of a planar or flat bar. An aperture 26 is provided in a first, distal, end of an arm 28 of the lever 24 to enable the lever 24 to be linked to the rail or stile 26 of the window sash (glazed panel) 27. The end of the lever 24 may be connected directly to the window sash 27, or alternatively may be connected to one or more arms 30 that provide a hinged connection between the lever 24 and the window sash 28, as is well known in the art. Where the end of the lever 24 is connected directly to the sash 27, connecting means (not shown) at the end of the lever 24 allow a rotatable and slidable connection to be made to the rail or stile 26 of the window. When the end of the lever 24 is connected to further arms 30, a rotatable pivot pin 32 may be located in the aperture 26 at the end of the lever 24 so as to provide a purely rotational connection to the additional hinged arms 30.

Figure 18:
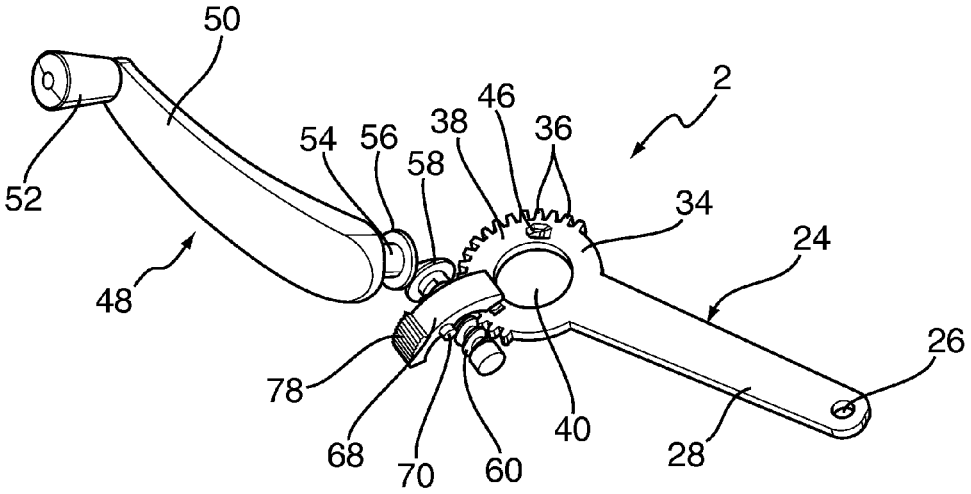
FIG. 18 is a perspective view of the winding mechanism of the winder assembly of FIG. 17.

At a second end of the actuating member or lever 24 there is an annular portion 34. A series of teeth 36 project radially outwards from part of the circumference of the annular portion 34. The teeth 36 extend in the same plane as the actuating member 24 and in this way the toothed part of the annular portion 34 forms a segment of a spur gear 38. As shown in FIG. 18, the toothed region 38 extends around approximately half of the circumference of the annular portion 34. The arm 28 of the actuating lever 24 extends radially from the part of the annular portion 34 without teeth. In this way, the spur gear segment 38 is provided at the proximal end of the actuating member 24.

The annular portion 34 of the actuating lever 24 locates around the spindle 22 in the support bracket 4. The diameter of the hole 40 in the centre of the annular portion 34 is only slightly larger than the diameter of the spindle 22 so that there is a sliding fit between the annular portion 34 and the spindle 22. The spindle 22 acts as a fixed axle, about which the actuating member 24 is able to rotate.

Figure 21:
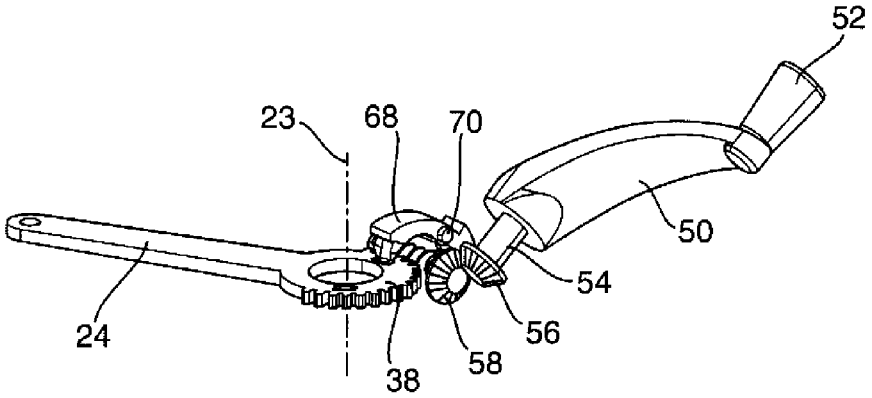
FIG. 21 is a perspective view of the winding mechanism of FIG. 18 viewed from a different angle.

The dimension, or diameter, of the upper retaining plate 20 is larger than the diameter of the spindle 22 so that the actuating lever 24 is prevented from sliding off the spindle 22 in this direction. Furthermore, a lower retaining plate 44 intersects a lower portion of the spindle 22 beneath the actuating lever 24, which retains the annular portion 34 of the lever 24 in the desired position on the spindle 22. The gap between the upper 20 and lower 44 retaining plates is such that little axial movement of the annular portion 34 is possible while still allowing the actuating member 24 to rotate about the spindle 22, about an axis 23 shown in FIG. 21.

Figure 22B:
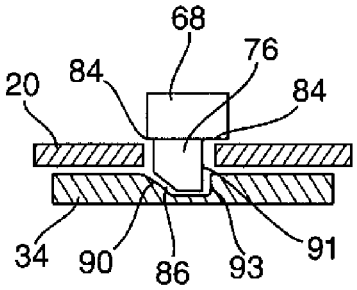
FIG. 22*b* is a partial cross-section along the line A-A of FIG. 17, showing the locking member, locking peg, upper retaining plate and recess in the actuating member.
Figure 22A:
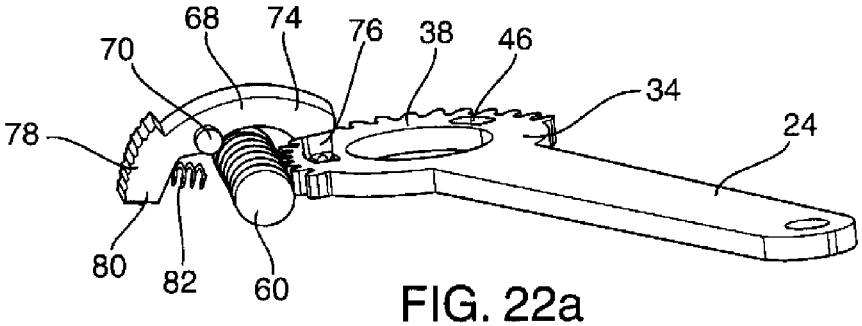
FIG. 22*a* is a perspective view showing part of the winder assembly of FIGS. 16 to 21.

As shown in FIGS. 18 and 22*a*, two recesses 46 are cut into the upper surface of the annular portion 34 or the recess may be indentations. The recesses 46 are positioned within the spur gear segment 38 and each recess 46 is located close to and the same circumferential distance from each end of the toothed region 38. The form and function of the recesses 46 will be described in more detail later.

A handle 48 is used to operate the winding mechanism 2. The handle 48 comprises a crank, including a connecting member 50 and a grip 52, and a shaft 54. One end of the connecting member 50 is joined to a first end of the shaft 54 so that the axes of the shaft 54 and the connecting member 50 are substantially at right angles to each other. The grip 52 extends from the other end of the connecting member 50 such that the axes of the connecting member 50 and the grip 52 are substantially perpendicular to each other and the shaft 54 and grip 52 extend in opposite directions relative to the connecting member 50.

Optionally, a sleeve (not shown) may also be fitted over the grip 52 of the handle 48. This sleeve is rotatably connected to the grip 52 so that a user of the winder assembly 1 may hold the sleeve with a hand when turning the handle 48, and the sleeve rotates coaxially relative to the grip 52 but remains stationary relative to the hand of the user.

It will be appreciated that the handle 48 may be of any suitable design such that the handle 48 can be used to rotate the shaft 54.

A gear train links the shaft 54 of the handle 48 and the actuating lever 24, so that rotation of the handle 48 causes a corresponding rotation of the annular portion 34 of the actuating lever 24 about the axis 23 of the spindle 22.

In particular, the second end of the handle shaft 54 is rigidly joined to a first bevel gear 56. This first bevel gear 56 engages with a second bevel gear 58 so that the axis of rotation is turned through approximately 90°. The pair of bevel gears 56, 58 may be arranged such that the angle between the axes of rotation of each of the bevel gears is any angle between 0° and 180°. The bevel gears may have straight or spiral teeth. Furthermore, the change of direction of the rotational axis may also be accomplished by the use of other gear combinations, for example crossed helical gears.

The second bevel gear 58 is, in turn, connected to one end of a worm gear 60. The helical tooth of the worm gear 60 engages with the spur gear segment 38 of the actuating lever 24 to complete the gear train.

The use of a worm gear 60 in this arrangement creates relatively large gear reductions so that a complete rotation of the handle 48 only causes a partial rotation of the actuating member 24. For each 360° rotation of the worm gear 60 about its axis, the annular portion 34 only advances one tooth 36 of the spur gear 38.

Figure 19:
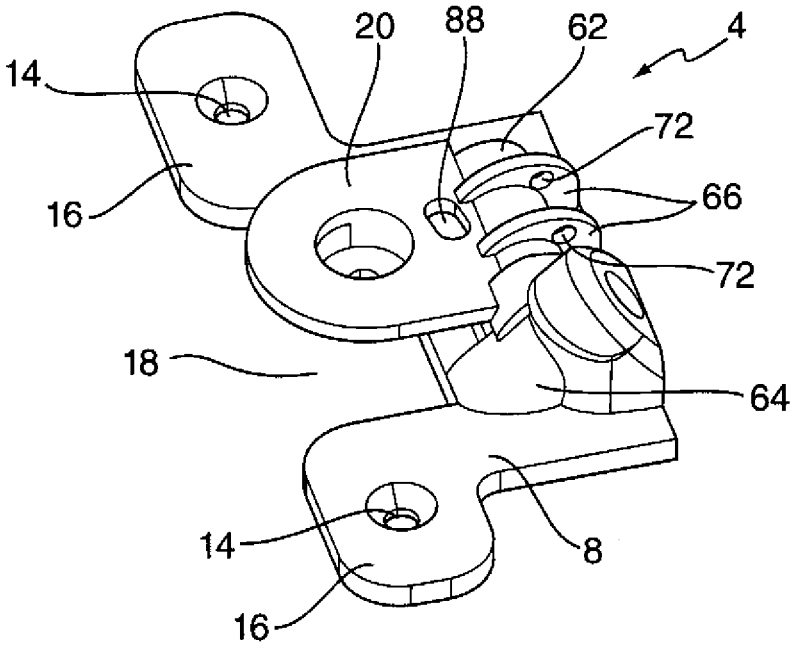
FIG. 19 is a perspective view of the support bracket of the winder assembly of FIG. 17.
Figure 20:
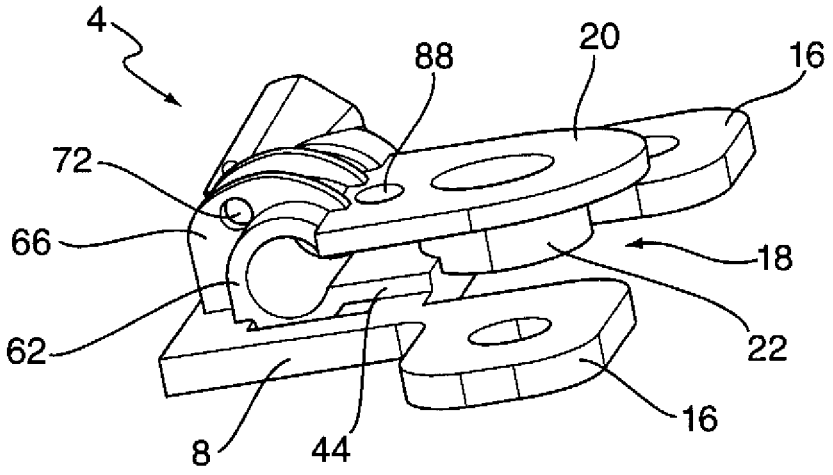
FIG. 20 is a second perspective view of the support bracket of FIG. 19 viewed from a different angle.

The gear train of the winding mechanism 2 is covered by intersecting tubular sleeves 62, 64 in the support bracket 4, shown in FIGS. 19 and 20. A first sleeve 62 covers the worm gear 60 and second bevel gear 58, and the axis of this sleeve 62 lies parallel to the mounting plate 8. A second sleeve 64 covers the shaft 54 and first bevel gear 56, and this second sleeve 64 extends at an angle from the mounting plate 8.

A pair of parallel guide ribs 66 project at right angles from the first sleeve 62. The guide ribs 66 are positioned such that the gap between the ribs 66 spans approximately the central third of the length of the first sleeve 62. Furthermore, a line extending radially from the axis of rotation 23 of the actuating lever 24 and running parallel to the guide ribs 66 bisects the gap between the ribs 66.

It will be appreciated that although the features of the support bracket 4 have been described individually, the features, for example the mounting plate 8, retaining plates 20, 44, spindle 22 and covers 62, 64, may be integrally formed. Preferably, the support bracket is made of a plastics material and formed in one piece by injection moulding.

A locking member 68 is located between and embraced by the guide ribs 66 and comprises a longitudinally curved beam, the curvature defining an upper convex curved surface and a lower concave curved surface. Cylindrical projections, or trunnions 70, project from opposing long sides of the locking member 68. These trunnions 70 locate in corresponding holes 72 in each of the ribs 66, so that the locking member 68 is supported by and pivots about these trunnions 70.

A first end 74 of the locking member 68 protrudes over the upper retaining plate 20. A locking peg 76 is rigidly fixed to the first end 74 of the locking member 68 and extends in a direction substantially towards the upper retaining plate 20. A raised region 78 is provided at the second end 80 of the locking member 68, on the upper convex surface. This raised region forms a button 78, such that when the button 78 is depressed, the locking member 68 pivots about the trunnions 70 and the first end 74 of the locking member 68 and the locking peg 76 are raised in a direction away from the actuating lever 24. The raised button 78 has a number of ridges and grooves formed in its surface to aid grip of a user's finger on the button 78.

Biasing means 82, in this case a compression spring 82, is located at the second end 80 of the locking member 68, between the lower concave surface and a part of the first sleeve 62 of the support bracket 4. When no force is applied to the button 78, the spring 82 exerts a restoring or biasing force on the second end 80 of the locking member 68 that causes the locking member 68 to pivot about its supports 70 and urge the first end 74 of the locking member 68 and the locking peg 76 towards the actuating lever 24. In this way, the locking peg 76 is biased towards the upper retaining plate 20 and the actuating lever 24.

The locking peg 76 has a generally rectangular cross-section, with two opposing longer edges lying tangentially with respect to the annular portion 34 of the actuating lever 24 and parallel to the end of the locking member 68. The length of these longer edges, however, is less than the width of the locking member 68, so that the locking member 68 includes shoulders 84 extending around at least three sides of the locking peg 76. In addition, one of the shorter edges at the free end of the peg 76 is bevelled or chamfered so as to define a sloping face 86 of the peg 76.

A generally rectangular aperture 88 is provided in the upper retaining plate 20 of the support bracket 4. The dimensions of this aperture 88 are slightly larger than the cross-sectional dimensions of the locking peg 76, and in this way, the peg 76 is able to pass through the aperture 88 without contacting the edges of the aperture 88.

The recesses 46 in the annular portion 34 of the actuating lever 24 also have a generally rectangular cross-section, thereby having two shorter walls, two longer walls and a base. The dimensions of the opening of the recess 46 at the upper surface of the annular portion 34 are approximately the same as the dimensions of the aperture 88 in the upper retaining plate 20, and the depth of the recess 46 is between half and three-quarters of the thickness of the actuating lever 24. One of the shorter walls of the recess 46 is angled such that the base of the recess 46 has a smaller area than the opening of the recess 46. The opposing shorter wall and the two longer walls are perpendicular to the surface of the actuating lever 24. In this way, the shape of the recess 46 complements the shape of the free end of the locking peg 76, as shown in FIG. 22*b*.

When the recess 46 is not aligned with the aperture 88, the free end of the biased locking peg 76 passes fully through the upper retaining plate 20 and makes touching contact with the upper surface of the annular portion 34 of the actuating lever 24.

When the actuating lever 24 is rotated into a position such that the recess 46 is aligned with the aperture 88 in the upper retaining plate 20, the end of the locking peg 76 is urged into and locates in the recess 46. The length of the locking peg 76 is chosen such that, in this position, the shoulders 84 of the locking member 68 contact the upper retaining plate 20. With the peg 76 in this position, the rotation of the annular portion 34 with respect to the support bracket 4 is hindered, at least in one direction of rotation of the actuating lever 24.

When the actuating lever 24 rotates in a direction such that the angled wall 90 of the recess 46 is the trailing edge of the recess 46, then the sloping face 86 of the locking peg 76 is able to ride or slide up the angled wall 90 of the recess 46. The peg 76 is, therefore, removed from the recess 46 and the actuating lever 24 is able to continue to rotate in this direction. If the locking peg 76 is located in the recess 46, and the gear train tries to drive the actuating lever 24 to rotate in the direction such that the angled wall 90 of the recess 46 is the leading edge, then the annular portion 34 will be prevented from rotating by the contact of the opposing vertical faces 91, 93 of the peg 76 and recess 46. As described previously, to allow the actuating lever 24 to continue rotate in this direction, pressure must be applied to the button 78 at the second end 80 of the locking member 68 to raise the first end 74 of the locking member 68 and lift the peg 76 out of the recess 46.

In one embodiment of the present invention, the recesses 46 and locking peg 76 are shaped to prevent movement in either direction. Accordingly, in such an embodiment, the activation means must be operated in order to allow the window to move in an opening or closing direction once the locking peg 76 locates in the recess 46.

To complete the winder assembly 1, an outer cover 6 is provided that surrounds at least part of the support bracket 4 and winding mechanism 2. As shown in FIG. 16*a*, when the window is closed, the curved outer cover 6 envelops the majority of the support bracket 4 that would otherwise be visible to a user of the winder assembly 1. The outer cover 6 includes two apertures 92, 94. The first is a circular aperture 92 through which the shaft 54 of the handle 48 protrudes so that the crank is mounted on the end of the shaft 54 and extends from the outer surface of the cover 6. The second aperture 94 is rectangular and is positioned such that the button 78 on the second end 80 of the locking member 68 protrudes through a part of the aperture 94. The width of the second aperture 94 is such that there is a sliding fit of the button 78 in the aperture 94. To provide for movement of the button 78 during operation of the winder assembly 1, the length of the aperture 94 is longer than the button 78. When the locking member 68 is in a disengaged position, that is the locking peg 76 is not located in a recess 46 and the end of the peg 76 is in contact with the upper surface of the annular portion 34, the button 78 is positioned towards one end of the aperture 94. When the locking member 68 is in an engaged position, and the locking peg 76 is located in a recess 46, the button 78 will be positioned at the second end of the aperture 94 due to the rotation of the locking member 68 about its trunnions 70.

The operation of the winder assembly 1 will now be described in more detail with reference to, in particular, FIGS. 16*a*, 16*b*, 21 and 22*a*.

Typically the winder assembly 1 will be fixed to a sill of a window adjacent the hinged edge. As the window may be hinged on either a left- or right-hand side, the winder assembly 1, is designed such that the actuating lever 24 can be mounted for left- or right-handed opening.

When the winder assembly is fixed to the window frame 10 and sash 27, the actuating lever 24 is firstly rotated so that the lever arm 28 is on the opposite side of the axis of rotation 23 to the hinges of the window, that is to say, the actuating lever arm 28 is further from the window hinges than the annular portion 34 of the actuating lever 24. After the winder assembly 1 has been mounted in the correct position on the window sill, for example, the handle 48 is turned until the worm gear 60 engages teeth 36 proximal the desired end of the spur gear section 38 such that the arm 28 extends in a direction away from the hinges of the window. The actuating lever may then be connected to the sash 27 as described previously.

The annular portion 34 of the actuating lever 24 includes two recesses 46 one towards each end of the spur gear section 38. In this way, whichever orientation the actuating lever 24 is mounted in with respect to the rest of the winding mechanism 2, a recess 46 is in the correct position to facilitate locking of the window as will now be described.

When the window is in a closed position, as shown in FIG. 16*a*, the arm 28 of the actuating lever 24 lies parallel to the rail or stile 26 of the window sash 27. In this position, the worm gear 60 is in engagement with an end tooth 36 of the spur gear section 38 of the annular portion 34. In addition, the locking peg 76 is urged against the upper surface of the annular portion 34 by the compression spring 82.

To open the window, a user of the winder assembly 1 grips the crank handle 48 and rotates it in a first direction. This causes the annular portion 34 of the actuating lever 24 to rotate so that the end of the arm 28 of the lever 24 moves in a first direction away from the window frame 10 thereby opening the window. As the annular portion 34 rotates in this direction the end of the locking peg 76 slides over the surface of the annular portion 34 until the actuating lever 24 has rotated far enough that the peg 76 locates in a recess 46. The circumferential distance between the recess 46 and end tooth 36 of the spur gear section 38 determines how far the window may be opened before this locking action occurs. Preferably the distance is such that the window can be opened, at its maximum, to about 10 cm.

With the peg 76 engaged in the recess 46 the actuating lever 24 is unable to rotate further in this direction as the trailing face 93 of the recess 46 presses against the side 91 of the locking peg 76.

To open the window further the user presses the button 78 to disengage the locking peg 76. Pressing the button 78 causes the compression spring 82 to be compressed and the locking member 68 to rotate so that the peg 76 is raised clear of the recess 46. The length of the aperture 94 in the outer cover 6 of the winder assembly 1 is such that, when the button 78 is pressed and slid to the other end of the aperture 94, the end of the locking peg 76 is lifted clear of the recess 46 but is not lifted through the aperture 88 in the upper retaining plate 20.

This limit on the distance the first end of the locking member 68 is raised is also set by the length of the compression spring 82.

While keeping the button 78 pressed, the user can then continue to turn the handle 48 to open the window further. As soon as the recess 46 is no longer aligned with the aperture 88 in the upper retaining plate 20, the button 78 can be released. The compression spring 82 then exerts a restoring force on the locking member 68 and the locking peg 76 is biased against the annular portion 34. As the recess 46 is no longer aligned with the peg 76, the end of the peg 76 contacts the upper surface of the annular portion 34 and slides over this surface as the actuating lever 24 rotates.

In this way, the addition of the locking means to the winder assembly 1 acts as a safety feature. If a child was to turn the handle 48 of the winder assembly 1, the automatic engagement of the locking peg 76 would prevent the child opening the window beyond a certain distance. As a young child would likely be unable to simultaneously press the button 78 and turn the handle 48, the locking means guards against the child opening the window far enough that he or she is able to fall out of the open window.

To close the window the handle 48 is simply turned in the opposite direction. The button 78 does not have to be pressed at any stage during the closing operation due to the asymmetric sloped shape of the locking peg 76 and recess 46. The direction of rotation of the actuating lever 24 when the window is being closed is such that the angled wall 90 of the recess 46 is now the trailing edge. In this case, when the peg 76 drops into the recess 46 during the rotation, the bevelled face 86 of the peg 76 contacts the angled wall 90 of the recess 46. As the annular portion 34 rotates further, the sloping face 86 of the peg 76 slides up the angled wall 90 and the peg 76 slides up and out of the recess 46. In this way, the temporary engagement of the peg 76 in the recess 46 does not prevent rotation of the actuating member 24 in this direction.

It will be appreciated that it is the position of the recess 46 on the actuating lever 24 that determines how far the window may be opened before the peg 76 automatically engages to lock the rotation. Therefore, the recess 46 may be positioned at any suitable distance from the end of the spur gear section 38, and the distance may be chosen such that the window can be opened to a distance of less than or more than 10 cm.

Figure 23:
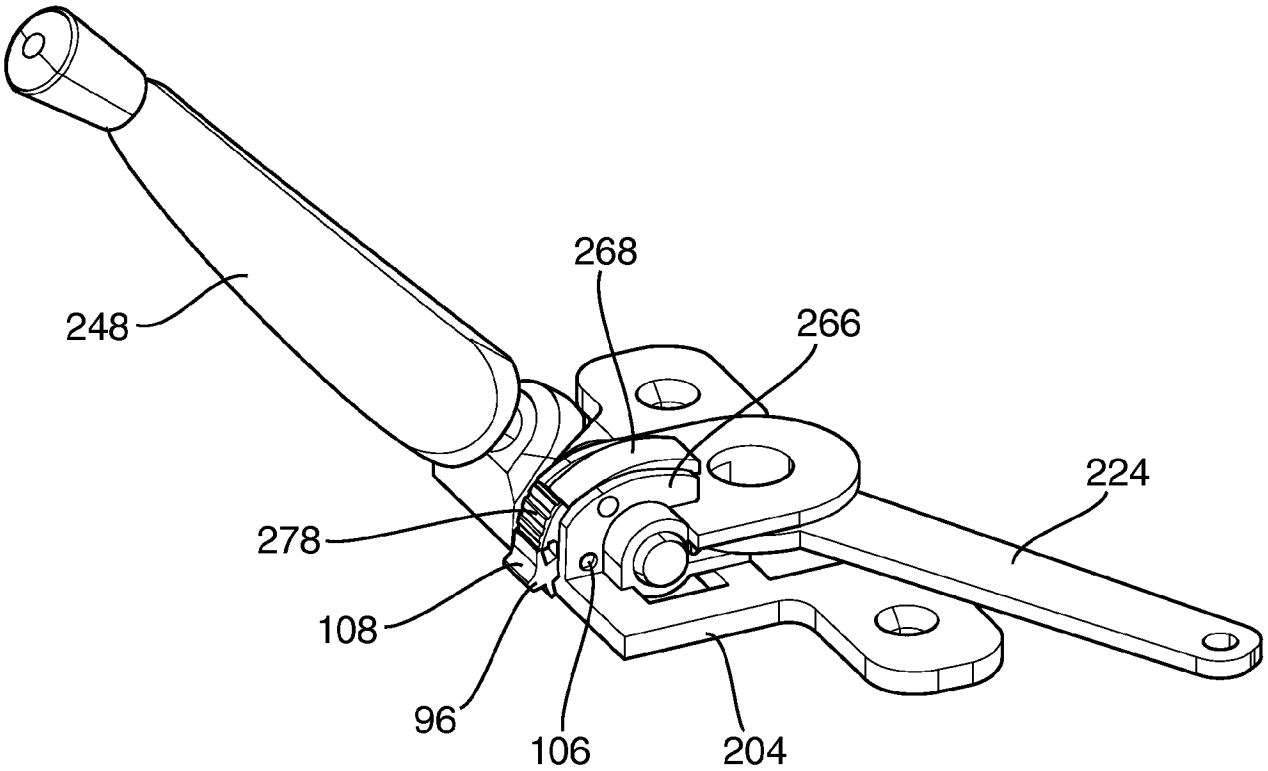
FIG. 23 is a perspective view of a second embodiment of a winder assembly in accordance with one aspect of the present invention with the cover removed.
Figure 24:
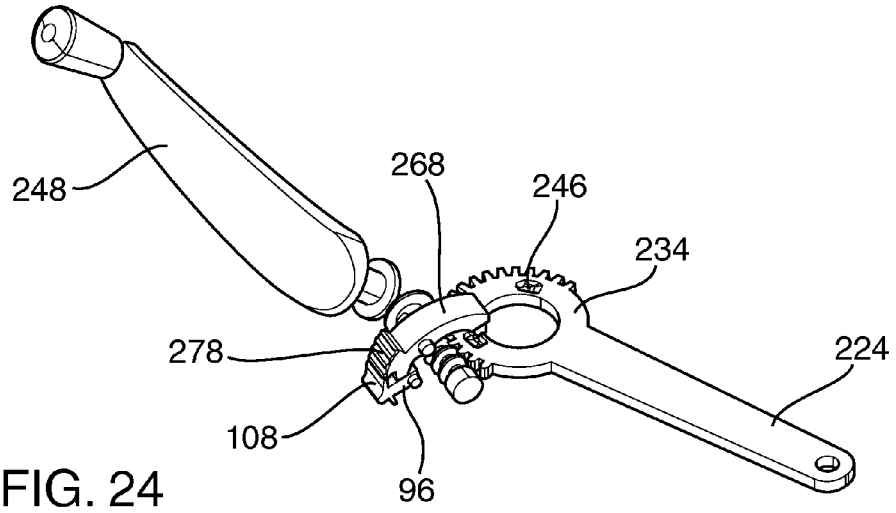
FIG. 24 is a perspective view of the winder assembly of FIG. 23 with the support bracket removed.
Figure 25A:
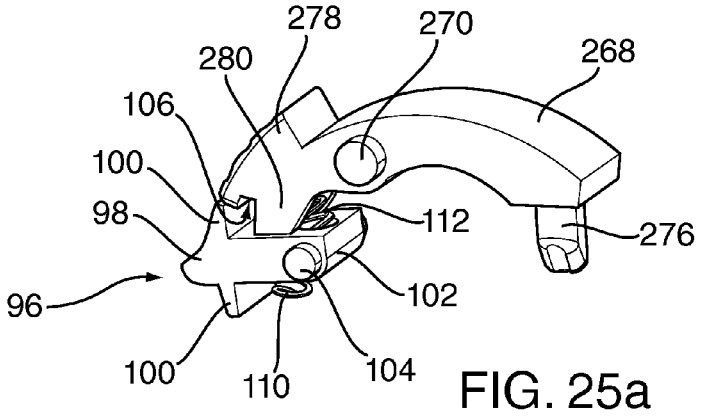
FIG. 25*a* is a perspective view of the locking means of FIG. 24.
Figure 25B:
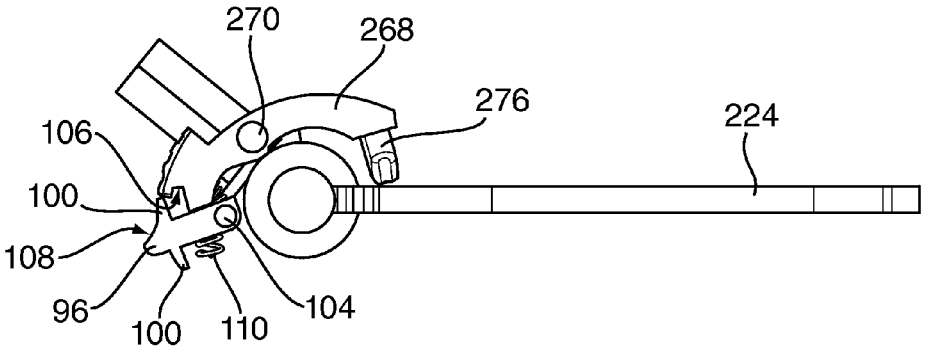
FIG. 25*b* is a side view of part of the winder assembly of FIG. 24.

A second embodiment of the invention is shown in FIGS. 23 to 25. This embodiment is substantially identical to the first embodiment except for part of the locking means and as such, features corresponding with those described above are indicated using reference numerals incremented by 200.

In this embodiment, the locking means additionally comprises a latch member 96. The latch member 96 comprises a rectangular block having a thickness substantially less than its length or width so as to define two faces and four sides. Proximal a first end 98 of the latch member 96, flanges 100 projects from both faces and extend the full width of the latch member 96. At the second end 102 of the latch 96, cylindrical projections, or trunnions 104, project from two opposing sides of the latch member 96, in a direction perpendicular to the flanges 100. These trunnions 104 locate in corresponding holes 106 in each of the guide ribs 266, so that the latch member 96 is supported by and pivots about these trunnions 104.

The latch member 96 is positioned with respect to the locking member 268 such that the second end 280 of the locking member 268 rests on an upper face of the latch member 96 between the flange 100 and the rotational axis through the trunnions 104. Further, the second end 280 of the locking member 268 comprises a notch 106 that extends the full width of the locking member 268.

A part of the surface of the latch member 96 extending between the upper flange 100 and the second end 98 of the latch member 96 forms a latch button 108. The latch button 108 is positioned adjacent to and is in contact with the raised button 278 on the locking member 268 and when the outer cover (not shown) of the winding assembly is in position, the latch button 108 protrudes through the aperture next to the locking member button 278. In this case, the length of the rectangular aperture in the cover is such that both the latch button 108 and the locking button 278 may slide within the aperture during operation of the winding mechanism.

In this embodiment, the locking means comprises two biasing means or compression springs 110, 112. A first compression spring 110 is positioned between the lower face of the latch member 96 and a part of the support bracket 204. A second compression spring 112 is located at the second end 280 of the locking member 268, between the lower concave surface of the locking member 268 and the upper face of the latch member 96. This second spring 112 is angled such that it acts upon the second end 102 of the latch member 96 on the opposite side of the pivot 104 to the flanges 100. The function of the second spring 112 is similar to the compression spring 82 of the first embodiment and acts to urge the locking peg 276 against the annular portion 234 of the actuating lever 224.

When the locking peg 276 engages in a recess 246 in the actuating lever 224, the locking member 268 pivots about its trunnions 270 and the second end 280 of the member 268 is raised. As the end of the locking member 268 lifts, the restoring force of the first compression spring 110 causes the latch member 96 to rotate about its respective trunnions 104. This relative movement of both the locking 268 and latch 96 members causes the flange 100 extending from the upper surface of the latch member 96 to engage in the notch 106 in the end of the locking member 268 thereby latching the locking means in a locked or engaged position.

To disengage the locking peg 276 from the recess 246, the locking member 268 must first be unlatched, that is to say the flange 100 must be pulled out of the notch 106. To do this, a user of the winding assembly must press the latch button 108 in a direction away from the locking member button 278. This compresses the first compression spring 110 and pulls the flange 100 out of the notch 106 in the locking member 268. In this position, the second compression spring 112 is still biasing the locking member 268 towards the actuating lever 224. Therefore, with the latch button 108 still pressed, the user must also slide the locking member button 278, as described previously, to disengage the locking peg 276. With both buttons 108, 278 pressed, the user is now able to turn the handle 248 to rotate the actuating lever 224 and continue to open the window.

Once the actuating lever 224 has rotated so that the recess 246 is no longer aligned with the locking peg 276, both buttons 108, 278 may be released.

The action of the latch member 96 is to prevent the locking member 268 from pivoting once the locking peg 276 is engaged in the recess 246. In this way, even if the actuating lever 224 is rotating in a direction to close the window, when the locking peg 276 locates in the recess 246, the latch member 96 rotates and the flange 100 engages in the notch 106. Therefore, even if the locking peg 276 and recess 246 have complementary sloped faces, the locking peg 276 is unable to rotate about its trunnions 270 and slide up and out of the recess 246. The latch button 108 and locking button 278 must, therefore, be pressed by a user of the winder assembly to continue to close the window once the locking means is engaged.

The addition of the latch member 96, therefore, increases the complexity of the locking means making it less likely that a young child will be able to operate the locking mechanism to allow them to open the window further than that permitted by the position of the recess. This further enhances and improves this safety feature of the winder assembly.

The window will not be movable by a child (or anyone else) by simply pushing or pulling the window as a result of the worm gear. However, the handle in the preferred embodiment and that of the prior art are rotatable by children and the present invention prevents children from opening the window by an unsafe amount. In the preferred embodiment the present invention provides an automatic lock at the 4" wide opening position that requires separate actions in addition to just winding the handle, to allow opening the window further. This prevents operation by a young child.

The restrictor of the present invention is automatically reset once the casement window is moved back or towards the closed position such that the casement window is within the predetermined restricted initial opening distance. Accordingly, the subsequent fully opening of the window will again require the user to operate the locking mechanism with the dual action requirement.

The invention claimed is:

1. A window winder assembly comprising:

a window winder comprising a rotatable handle such that rotation of the handle in a first or second rotational direction causes a corresponding movement of an actuating member in a first opening direction or a second closing direction, the actuating member being connectable to a window in order to move a window from a closed position to an open position;

a locking unit comprising:

locking means including a locking spindle and a locking member, wherein the locking spindle is engaged with the handle spindle and the handle spindle is engaged to rotate with rotation of the locking spindle;

wherein the locking means comprises a manual activation member to enable a user to disengage the locking means; and wherein, when the locking member is in the locked position, and the locking spindle is at a predetermined partially open locking position corresponding to a predetermined partially open position for a window, the locking member prevents rotation of the locking spindle in the opening direction which prevents rotation of the handle spindle in the opening direction and prevents the further movement of the actuating member in the opening direction beyond the predetermined partially open locking position; and wherein the manual activation member requires a dual action with both actions being performed simultaneously in order to disengage the locking means and in which the manual activation member comprises a first member and a second member which require independent manual operations to enable a user to disengage the locking means.

2. The window winder assembly according to claim 1, wherein the locking means is manually releasable in order to allow the window to be opened beyond the predetermined partially open position.

3. The window winder assembly according to claim 1, wherein the locking spindle comprises a first worm.

4. The window winder assembly according to claim 1 in which the handle spindle comprises a second worm.

5. The window winder assembly according to claim 1 in which the engagement means is arranged to axially engage the locking spindle with the handle spindle.

6. The window winder assembly according to claim 5 in which the engagement means is arranged to engage the locking spindle to an exposed outer end of the handle spindle.

7. The window winder according to claim 1, wherein a first end of the locking spindle comprises a series of grooves.

8. The window winder according to claim 7, wherein a second end of the locking spindle comprises splines.

9. The window winder assembly according to claim 1, wherein the locking means includes a pivoted locking member.

10. The window winder assembly according to claim 1, wherein the locking means comprises a control member.

11. The window winder assembly according to claim 10, wherein the control member comprises an abutment member.

12. The window winder assembly according to claim 10, wherein the control member is rotatable.

13. The window winder assembly according to claim 12, wherein the control member comprises a worm wheel.

14. The window winder assembly according to claim 11, wherein a locking peg is biased towards a movement path of the abutment member.

15. The window winder assembly according to claim 1, wherein at the predetermined partially open position a locking peg is urged into abutment with an abutment member in order to prevent further movement of the actuating member in the opening direction.

16. The window winder assembly according to claim 15, wherein the abutment member and/or the locking peg are shaped to prevent further movement of the actuating member from the partially open position in the opening direction.

17. The window winder assembly according to claim 15 in which the abutment member and/or the locking peg are shaped to allow further movement of the actuating member from the partially open position in the closing direction.

18. The window winder assembly according to claim 1, wherein, as the window is being opened the locking means automatically locks the window at a predetermined partially open position and, as the window is being closed from a position passed the partially open position, the locking means does not lock or engage the window to prevent closure of the window at the partially open position.

19. The window winder assembly according to claim 1, wherein the first member comprises a first button and the second member comprises a second button and in use, the second button is moved to an unlocked position and then the first button is moved to an unlocked position which maintains the second button in the unlocked position.

20. The window winder assembly according to claim 19, wherein the second button is held in an unlocked position by latching means and movement of the window beyond the predetermined open position causes the latching means to unlatch the second button which causes the locking means to be reset once the window moves back within the predetermined locking position.

21. The window winder assembly according to claim 20, wherein the latching means comprises magnetic means.

22. The window winder assembly according to claim 10, wherein the control member comprises a worm wheel.

23. The window winder assembly according to claim 22, wherein the worm wheel comprises an upper surface over which a locking peg is arranged to move and the upper surface of the worm wheel also include a raised portion which forms an abutment member of the locking means.

24. The window winder assembly according to claim 1 in which rotation of the handle is transmitted to a gear mechanism to cause rotation of an actuating worm which then engages with a worm wheel of the actuating member to cause movement of the actuating member.

25. The window winder assembly according to claim 1, wherein rotation of the handle is transmitted to a gear mechanism to cause rotation of a control worm which is engaged with a control worm wheel and the control worm wheel is arranged to prevent further rotation of the handle and/or movement of the actuating member in an opening direction at the predetermined restricted opening distance.

26. A method of installing a window winder assembly, the method comprising:

providing a locking unit and a window winder, wherein the window winder comprises a rotatable handle, whereby rotation of the handle in a first or second rotational direction causes a corresponding movement of an actuating member in a first opening direction or a second closing direction, the actuating member being connectable to a window in order to move a window from a closed position to an open position;

removing a handle of the window winder to expose a handle spindle;

engaging a locking spindle of the locking unit to the window winder, wherein the locking unit comprises the locking spindle and a locking member, wherein the locking spindle is engaged with the handle spindle and the handle spindle is engaged to rotate with rotation of the locking spindle, and wherein a manual activation member enables a user to disengage the locking spindle from the locking member;

moving a window in an opening direction to a predetermined partially open position;

preventing rotation of the locking spindle with the locking member in a locked position, thereby preventing rotation of a handle spindle in the opening direction, and thereby preventing further movement of the actuating member in the opening direction, wherein the manual activation member requires a dual action with both actions being performed simultaneously in order to disengage the locking spindle from the locking member and in which the manual activation member comprises a first member and a second member which require independent manual operations to enable a user to disengage the locking spindle from the locking member.

27. The method of installing a window winder assembly according to claim 26 in which the method comprises engaging the locking spindle with the handle spindle and attaching a handle to the locking spindle.

28. The method of installing a window winder assembly according to claim 26, wherein the method comprises converting an unlocking window winder to a locking window winder.

29. The method of installing a window winder assembly according to claim 26, wherein the method comprises retrospectively fitting the locking unit to an existing window winder.

30. The method of installing a window winder assembly according to claim 26, wherein the method comprises maintaining the window winder in situ whilst installing the locking unit.

31. An assembly comprising a window winder and a locking unit wherein the locking unit is in accordance with claim 1.

32. A method of opening and closing a window comprising operating a locking unit in accordance with claim 1.

33. The method of installing a window winder assembly according to claim 26, wherein the method comprises engaging the handle with the locking spindle such that the locking spindle engages with the handle spindle and the locking spindle is engaged to rotate with rotation of the handle spindle.

* * * * *